US012515097B2

(12) United States Patent
Morrison

(10) Patent No.: US 12,515,097 B2
(45) Date of Patent: Jan. 6, 2026

(54) PEDALING APPARATUS AND METHODS

(71) Applicant: William Morrison, Poulton-le-Fylde (GB)

(72) Inventor: William Morrison, Poulton-le-Fylde (GB)

( * ) Notice: Subject to any disclaimer, the term of this patent is extended or adjusted under 35 U.S.C. 154(b) by 142 days.

(21) Appl. No.: 18/486,223

(22) PCT Filed: Apr. 14, 2022

(86) PCT No.: PCT/GB2022/050948

§ 371 (c)(1),
(2) Date: Oct. 13, 2023

(87) PCT Pub. No.: WO2022/219349

PCT Pub. Date: Oct. 20, 2022

(65) Prior Publication Data

US 2024/0316399 A1 Sep. 26, 2024

(30) Foreign Application Priority Data

Apr. 15, 2021 (GB) ..... 2105389

(51) Int. Cl.

| | |
|---|---|
| ***A63B 22/06*** | (2006.01) |
| ***A63B 21/00*** | (2006.01) |
| ***A63B 21/22*** | (2006.01) |

(52) U.S. Cl.

CPC .... *A63B 22/0605* (2013.01); *A63B 21/00069* (2013.01); *A63B 21/225* (2013.01); *A63B 21/4033* (2015.10); *A63B 2022/0611* (2013.01)

(58) Field of Classification Search

CPC ..... A63B 22/0605; A63B 2022/0617; A63B 2022/0629; A63B 2022/0647

See application file for complete search history.

(56) References Cited

U.S. PATENT DOCUMENTS

| | | | | |
|---|---|---|---|---|
| 7,510,512 | B1 * | 3/2009 | Taggett | A63B 21/0088 482/111 |
| 8,409,060 | B2 * | 4/2013 | Hsu | A63B 22/0015 482/57 |
| 10,478,660 | B2 * | 11/2019 | Bayerlein | A61H 1/0281 |
| 11,801,419 | B2 * | 10/2023 | Bissonnette | A63B 23/12 |
| 11,957,956 | B2 * | 4/2024 | Bissonnette | A63B 21/015 |

(Continued)

FOREIGN PATENT DOCUMENTS

| | | | |
|---|---|---|---|
| DE | 102014116543 | A1 | 6/2015 |
| EP | 1 920 748 | A1 | 5/2008 |

(Continued)

*Primary Examiner* — Zachary T Moore

(74) *Attorney, Agent, or Firm* — Woodard Emhardt Henry Reeves & Wagner LLP

(57) ABSTRACT

An epicyclic pedalling apparatus comprising: a first epicyclic arm comprising a first pedal crank arm connection for coupling a first pedal crank arm to the first epicyclic arm to enable pedalling of said first pedal crank arm about a first spindle axis; and a second epicyclic arm comprising a second pedal crank arm connection for coupling a second pedal crank arm to the second epicyclic arm to enable pedalling of said second pedal crank arm about a second spindle axis; wherein the apparatus is arranged to enable: (i) the first epicyclic arm to rotate to move the first spindle axis, and (ii) the second epicyclic arm to rotate to move the second spindle axis.

20 Claims, 4 Drawing Sheets

(56) References Cited

U.S. PATENT DOCUMENTS

| | | | | |
|---|---|---|---|---|
| 2005/0263978 | A1* | 12/2005 | Ascher | B62M 9/08 280/261 |
| 2007/0298935 | A1 | 12/2007 | Badarneh et al. | |
| 2011/0275486 | A1* | 11/2011 | Hsu | A63B 22/0015 482/57 |
| 2015/0238805 | A1 | 8/2015 | Yang | |
| 2015/0258365 | A1* | 9/2015 | Neill | A63B 21/0125 482/54 |
| 2020/0038705 | A1 | 2/2020 | Van Straaten et al. | |
| 2022/0226692 | A1* | 7/2022 | Hsu | A63B 21/00181 |

FOREIGN PATENT DOCUMENTS

| | | | |
|---|---|---|---|
| GB | 2579167 | A | 6/2020 |
| JP | 2003011878 | A | 1/2003 |
| JP | 2007083811 | A | 4/2007 |
| WO | WO 2006/004430 | A2 | 1/2006 |

* cited by examiner

PEDALING APPARATUS AND METHODS

TECHNICAL FIELD

The present disclosure relates to the field of exercise apparatuses such as pedalling devices for exercising.

BACKGROUND

Exercise is important for humans to stay healthy, and it can help with recovery from injuries or other illnesses. However, many people may be in a situation which significantly impedes their ability to exercise, such as those who are bed bound in a hospital or whose bodies are incapable of withstanding impact resulting from exercise. Whilst certain low impact forms of exercise such as swimming can be recommended, for many reasons this is not always feasible for some individuals. For example, users who are bed bound may not be able to get to a swimming pool. In any case, swimming does not generally provide adequate training of a person's legs. Instead, it is a sport which mainly uses upper body muscles, and so may not be so helpful for a user recovering from a leg injury who needs to train their leg muscles.

Stationary cycling machines (such as 'spinning bikes') are known. These can enable a user to train their leg muscles in a controlled and low impact fashion. However, such cycling machines are typically very quad-biased in terms of the muscle groups they target. For example, 50% or more of the power applied by a cyclist may come from their quads, yet as little as 5% may come from the hamstrings. It is apparent that such machines may therefore provide an undesirable imbalance in their resulting training load. It may therefore be desirable to provide an exercise machine capable of reducing this imbalance in training load.

In addition, it may be preferable to provide an exercise machine which provides low impact training for a person who is bed bound, such as a patient in hospital, or who is in a state in which they would otherwise be unable to provide any sort of exercise to their legs. As the legs make up such a significant part of a user's body, it is important that they do not go for long without getting any exercise. For example, it can be very deleterious for a user who is bed bound in hospital to go for any length of time without getting some sort of exercise for their legs. Furthermore, as there are many different groups of muscles within the legs, it may be preferable to provide a means for enabling a user to train the majority of the muscle groups within the legs, without there being a substantial muscle-group imbalance.

GB 2579167 discloses a pedalling apparatus comprising an epicyclic drive train in which a plurality of planet wheels are constrained to orbit about a sun wheel. A ring holds the planet wheels in place so that they are in contact with the sun wheel. This arrangement enables the planet wheels to orbit about the sun wheel by interacting with both the ring and sun wheel. One of the planet wheels has connections for attaching pedal cranks thereto so that a user can pedal the apparatus. Pedalling of these pedal cranks will cause the planet wheel to spin about its spindle axis. The apparatus is arranged so that this spinning of the planet wheel may selectively cause the planet wheels to also orbit about the sun wheel.

SUMMARY

Aspects of the disclosure are set out in the independent claims and optional features are set out in the dependent claims. Aspects of the disclosure may be provided in conjunction with each other, and features of one aspect may be applied to other aspects.

In an aspect, there is provided an epicyclic pedalling apparatus comprising: a first epicyclic arm comprising a first pedal crank arm connection for coupling a first pedal crank arm to the first epicyclic arm to enable pedalling of said first pedal crank arm about a first spindle axis; and a second epicyclic arm comprising a second pedal crank arm connection for coupling a second pedal crank arm to the second epicyclic arm to enable pedalling of said second pedal crank arm about a second spindle axis. The apparatus is arranged to enable: (i) the first epicyclic arm to rotate to move the first spindle axis, and (ii) the second epicyclic arm to rotate to move the second spindle axis.

Embodiments may provide an apparatus arranged to enable epicyclic pedalling to occur. That is, the apparatus may enable a user to pedal the pedal crank arms about their respective spindle axes, and for those spindle axes to move. In particular, the spindle axes may be moved to any point on the circumference of a circle. For each pedal crank arm, that circle is centred on an axis (e.g. a central axis) about which the corresponding epicyclic arm rotates, and the radius of that circle is the distance by which the spindle axis is offset from that central axis (e.g. the distance of separation between that axis and the pedal crank arm connection). This may enable pedalling to be provided at a plurality of different locations—e.g. distances of separation of the spindle axes from the user. This may enable pedalling to exercise a greater variety of muscle groups.

Facilitating such a range of pedalling motions may provide a number of exercise-related benefits, and these may be achieved for a number of different types of user. Pedalling the apparatus in any position may be performed to provide aerobic training. The apparatus may also make it easier for individuals to perform high-intensity training. For example, the spindle axes may be moved into positions in which a user can engage more powerful muscles. Providing easy access to use of these powerful muscles may make it easier for a user to increase their exercise intensity (e.g. raise their heart rate to higher levels). The apparatus may also be operated to provide resistance training to a user (e.g. by applying resistance to the pedalling motion). The apparatus may enable resistance to be applied in different positions for the spindle axes, so that different muscle groups can be targeted.

Another exercise-related benefit may to provide dynamic stretching and strength development for users. As the spindle axes move, the user may have to adjust to different pedalling positions. Of note, as the spindle axes move further away from them, they may need to stretch their muscles more to reach the pedals and/or they may need to actively engage additional muscles, such as their core, to facilitate such pedalling motion. For example, operation of the apparatus could be controlled to provide a pedalling motion for a user in a position which requires more stretching and/or core involvement than for conventional cycling. This may enable the user to increase flexibility, develop more strength when in stretched positions, and/or to also target development of their core muscles through a pedalling motion. The apparatus may be operated to provide progressive eccentric/concentric muscle group contractions. This may be targeted at each of a number of different muscle groups (due to movement of the spindle axes).

These benefits may find application to a number of different types of users. For example, elite athletes may benefit from being able to train (e.g. high-intensity cardio) while also having stretching benefits, such as increase their strength when stretched, increasing core strength, and/or increasing general flexibility. The apparatus may enable these benefits while also enabling a user to pedal the apparatus in a non-load-bearing capacity. In other words, the apparatus may enable a user to obtain these benefits while avoid additional stresses being placed through a user's joints. This may prove beneficial for elite athletes who are recovering from an injury, as they may still be able to train without overly stressing their injury. This also applies to rehabilitation of patient's or the elderly for whom exercising may be hard to do e.g. without putting undue stress through their joints. For example, bed bound patients (e.g. recovering from an operation) may still be able to user the apparatus to retain strength in these different muscle groups, which may facilitate they recovery/rehabilitation. This may also apply to other individuals, e.g. those suffering from sarcopenia, as the apparatus may enable a range of muscle groups to be targeted. This includes muscle groups in addition to those targeted by conventional cycling motion, such as muscle groups which aid in sitting to standing motion. This may help when rehabilitating patients and improving their mobility.

The first and second spindle axes may be coaxial. In other words, the first and second spindle axes may be the same, e.g. they may form a common spindle axis. The apparatus may comprise a resistance element operable to provide resistance to pedalling of said first and second pedal crank arms. The resistance element may be configured to provide a selectively variable resistance to pedalling of said first and second pedal crank arms. For example, the apparatus may be arranged to transmit rotation of the pedal crank arms about their respective spindle axes into rotation of another component (e.g. a resistance wheel). Rotation of that component may be controlled, e.g. so that a variable resistance is applied to it to provide variable resistance to the pedalling motion of the pedal crank arms about their respective spindle axes.

The first epicyclic arm may be arranged to separate the first spindle axis from the axis about which the first epicyclic arm is configured to rotate. For example, the first epicyclic arm may separate the first spindle axis from a central axis about which the first spindle axis may rotate. The first epicyclic arm may extend from a central region (through which the central axis runs) to a spindle region (through which the first spindle axis runs). The first epicyclic arm may be rigid. The first epicyclic arm may be configured to support pedalling of the first pedal crank arm about the first spindle axis. The first epicyclic arm may be configured to transmit rotational motion of the first pedal crank arm about the first spindle axis into rotational motion of another component about a different axis. For example, the first epicyclic arm may be configured to transmit rotational motion of the pedal crank arm being pedalled about the first spindle axis into rotational motion of a central shaft rotating about the central axis. The first epicyclic arm may be arranged to separate the first spindle axis from the central axis (so that the two are different axes) and to enable rotation about the first spindle axis (by the first pedal crank arm) to be transmitted into rotation about the central axis (by the central shaft). The second epicyclic arm may be arranged in this same manner as the first epicyclic arm.

The first and second epicyclic arms may be coupled to each other so that pedalling of one of said first and second pedal crank arms about its respective spindle axis also drives a corresponding rotation of the other said pedal crank arm about its respective spindle axis. For example, the first and second pedal crank arms may be coupled to transmit rotation therebetween (e.g. so that the first and second pedal crank arms always rotate together, and remain at a fixed phase offset to each other, such as a 180° phase offset). The apparatus may be configured to transmit rotation from the pedal crank arms about the spindle axes into rotation of a common shaft. For example, each pedal crank arm may be coupled to that shaft so that rotation of that pedal crank arm about its spindle axis drives rotation of that shaft about a shaft axis (separate to the spindle axis). Rotation of the shaft about the shaft axis may drive rotation of each pedal crank arm about its spindle axis (e.g. to ensure the two pedal crank arms rotate together). The shaft may also be coupled to a resistance element to apply resistance to the pedalling motion of the pedal crank arms about their spindle axes.

The first epicyclic arm may comprise a first connection wheel configured to rotate about the first spindle axis in response to pedalling of said first pedal crank arm. The second epicyclic arm may comprise a second connection wheel configured to rotate about the second spindle axis in response to pedalling of said second pedal crank arm. The first connection wheel may be coupled to the second connection wheel so that a rotation of one connection wheel drives a corresponding rotation of the other connection wheel. For example, each connection wheel may be configured to rotate in response to pedalling of its associated pedal crank arm about its spindle axis, and said rotation of the connection wheel may be provided to a central shaft which rotates about a shaft axis in response to pedalling.

Each of the first and second epicyclic arms may be configured to rotate about a central axis to provide said respective movement of the first and second spindle axes. The central axis may be an axis running transverse to the pedalling apparatus (to the different wheels of the apparatus). The central axis may be parallel with the first and/or second spindle axes. The first epicyclic arm may comprise a first central wheel configured to rotate about the central axis in response to pedalling of said first pedal crank arm. The second epicyclic arm may comprise a second central wheel configured to rotate about the central axis in response to pedalling of said second pedal crank arm. A central shaft may couple the first central wheel to the second central wheel so that the first and second central wheel rotate together. The central shaft may be arranged to rotate about a central axis (as may the first and second central wheels). The central axis may be offset from the spindle axes.

The resistance element may comprise a resistance wheel coupled to the central shaft and configured to resist rotation of the central shaft. The resistance wheel may be coupled to external resistance means, such as a flywheel and/or an eddy current brake, to provide resistance to rotation of the resistance wheel about the central axis thereby to resist rotation of the central shaft. The first connection wheel may be coupled to the first central wheel to transmit rotational movement therebetween. The second connection wheel may be coupled to the second central wheel to transmit rotational movement therebetween. Each connection wheel may be coupled to its respective central wheel with a belt.

The apparatus may comprise a driving mechanism operable to drive rotation of each said epicyclic arm to provide said movement of the first and second spindle axes. The driving mechanism may comprise a driving wheel, wherein both of the first and second epicyclic arms are coupled to the driving wheel so that rotation of the driving wheel provides rotation of the first and second epicyclic arms. The driving mechanism may comprise a driver coupled to the driving wheel and configured to provide selective rotation of said driving wheel thereby to provide selective rotation of the first and second epicyclic arms. The driver may comprise a motor. The driving mechanism may comprise two or more breakout wheels arranged to provide a rotational coupling between the first epicyclic arm and the second epicyclic arm. The breakout wheels may be arranged to rotate about a different axis to the rotational axis of the first and second epicyclic arms. The pedalling apparatus may be arranged to enable transmission of rotation between: (i) the first epicyclic arm and the breakout wheels, and (ii) the second epicyclic arm and the breakout wheels.

The pedalling apparatus may be configured to transmit of rotation between the first and second epicyclic arms via rotation of a component about a different rotational axis (e.g. as compared to the rotation of the epicyclic arms about the central axis). The apparatus may be configured to transmit rotation between the epicyclic arms without affecting rotation of the central shaft and/or components coupled thereto, such as the connection wheels, belts, central wheels and/or the resistance wheel. The apparatus may be arranged to transmit rotation from the first epicyclic arm to the second epicyclic arm via rotation of one or more components about an offset rotational axis located away from the central shaft and/or said components coupled to the central shaft (and arranged to rotate about the central axis).

The first epicyclic arm may be rotationally coupled to a first breakout wheel at a location away from the resistance wheel on a first side of the resistance wheel. The second epicyclic arm may be rotationally coupled to a second breakout wheel at a location away from the resistance wheel on a second side of the resistance wheel. This may enable rotation to be transmitted between: (i) the first epicyclic arm and the breakout wheels at the location away from the resistance wheel on the first side of the resistance wheel, and (ii) the breakout wheels and the second epicyclic arm at the location away from the resistance wheel on the second side of the resistance wheel.

The apparatus may comprise a controller operable to control at least one of: (i) a pedalling resistance for the epicyclic pedalling apparatus, and (ii) a rotational position of the first and second spindle axes. The controller may be configured to receive a control signal indicative of a performance characteristic for operation of the epicyclic pedalling apparatus and/or for a user using the pedalling apparatus. The controller may be configured to control at least one of the pedalling resistance and the rotational position based on the control signal. The controller may be configured to control the resistance based on the spindle axis position and/or to control the spindle axis position based on the resistance. For example, the controller may be configured to control operation of the pedalling apparatus to provide selected pedalling resistance to selected spindle axis positions.

In an aspect, there is provided an exercise apparatus comprising: the epicyclic pedalling apparatus as disclosed herein; and a gantry. The gantry is operable to vary an elevation of the epicyclic pedalling apparatus relative to a user of the pedalling apparatus. The gantry may be configured to enable a user to pedal the pedalling apparatus in a supine position (e.g. with the pedalling apparatus 100 elevated above the user, so that the user's legs may be elevated relative to the rest of their body for pedalling).

In an aspect, there is provided a method of controlling operation of an epicyclic pedalling apparatus, the epicyclic pedalling apparatus comprising: (i) a first pedal crank arm coupled to a first epicyclic arm and arranged to be pedalled about a first spindle axis, and (ii) a second pedal crank arm coupled to a second epicyclic arm and arranged to be pedalled about a second spindle axis. The method comprises: controlling at least one of: (a) rotational movement of the first epicyclic arm to control the position of the first spindle axis, (b) rotational movement of the second epicyclic arm to control the position of the second spindle axis, (c) a pedalling resistance for pedalling of the first and second pedal crank arms about their respective spindle axes.

Aspects of the present disclosure provide a computer program product comprising computer program instructions configured to program a controller to perform the methods of the present disclosure.

BRIEF DESCRIPTION OF THE DRAWINGS

Some examples of the present disclosure will now be described, by way of example only, with reference to the figures, in which.

In the drawings like reference numerals are used to indicate like elements.

SPECIFIC DESCRIPTION

Figure 1A:
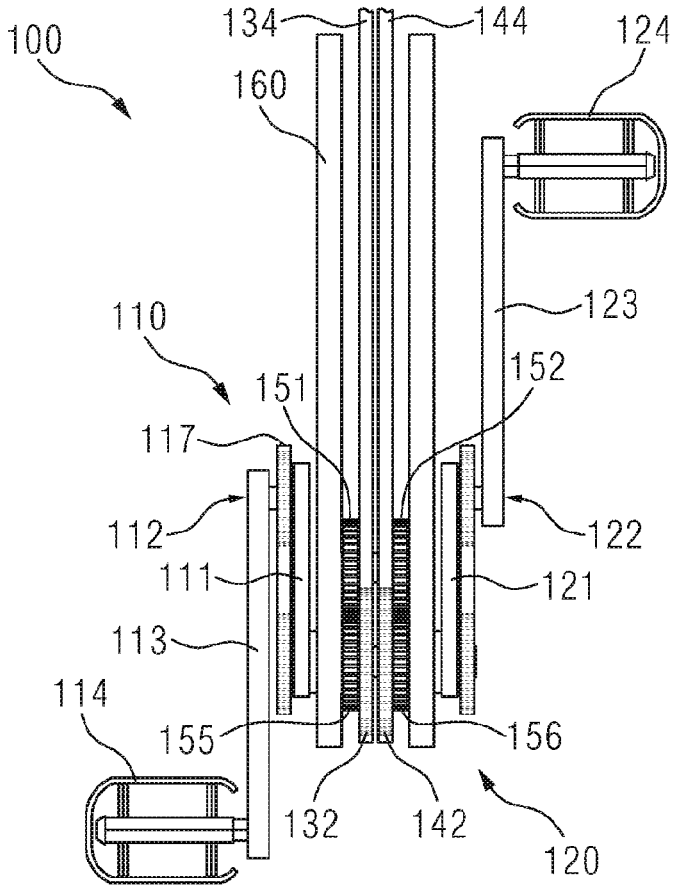
FIGS. 1*a* to 1*e* show schematic diagrams of an exemplary pedalling apparatus.
Figure 1B:
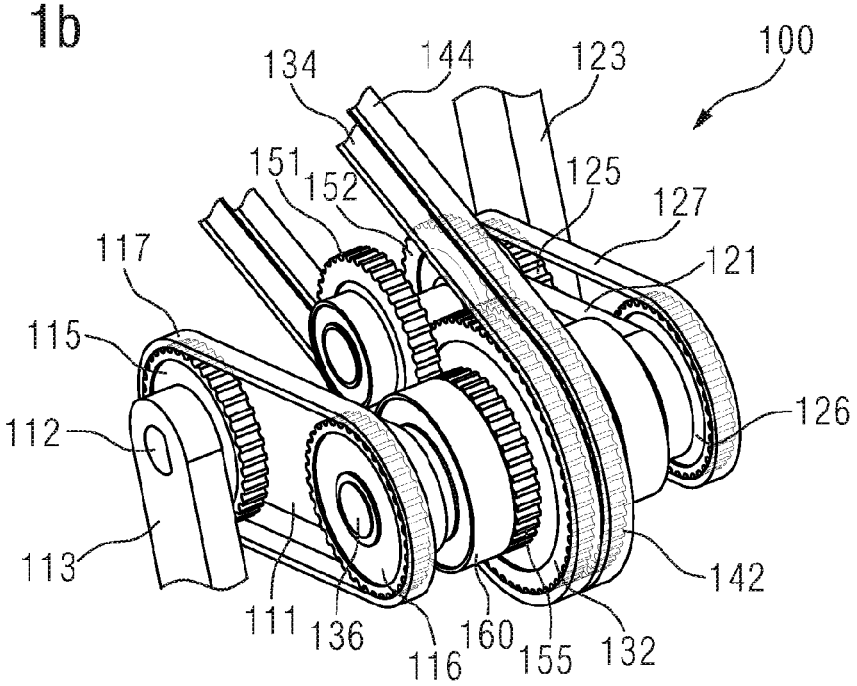

The present disclosure relates to a pedalling apparatus which a user may pedal for exercise. The axis about which a user pedals (a spindle axis) may be moved relative to the user. This may enable a wider variety of muscle groups to be targeted during exercise. For example, increasing the distance of the crank arms from a user may target that user's glute and core muscles more than in a conventional cycling position (which is typically a quad-focussed exercise). The pedalling apparatus has a first and second epicyclic arm. A respective pedal crank arm may be connected to each epicyclic arm, and each epicyclic arm is arranged to rotate (e.g. about a central axis). Rotation of the epicyclic arms enables the pedal crank arms (and spindle axis) to also move relative to a user. For each epicyclic arm, the pedal crank arm connected to that epicyclic arm may rotate about a spindle axis, and the epicyclic arm itself may rotate about a central axis (different to the spindle axis). The pedal crank arms may then be pedalled in an epicyclic trajectory, as they can be pedalled in a circular motion about the spindle axis, and that spindle axis can be provided at any point on the circumference of a circle (by rotation of the epicyclic arm about the central axis moving the location of the spindle axis).

An example of a pedalling apparatus will now be described with reference to FIGS. 1*a* to 1*e*.

FIGS. 1*a* to 1*e* show pedalling apparatus 100. The pedalling apparatus 100 includes a first epicyclic arm 110 and a second epicyclic arm 120. The first epicyclic arm 110 includes a first body 111, a first pedal crank arm connection 112, a first connection wheel 115, a first central wheel 116, and a first belt 117. The second epicyclic arm 120 includes a second body 121, a second pedal crank arm connection 122, a second connection wheel 125, a second central wheel 126, and a second belt 127. A first pedal crank arm 113 and first pedal 114 are shown, as are a second pedal crank arm 123 and second pedal 124.

The apparatus 100 includes a resistance wheel 132, and a resistance belt 134. The apparatus 100 includes a driving wheel 142 and a driving belt 144. A central shaft 136 is included, as is a breakout shaft 153 (as seen best in FIG. 1*c*). The apparatus 100 includes a first breakout wheel 151, a second breakout wheel 152, a first transmission wheel 155 and a second transmission wheel 156. The apparatus 100 also includes a housing 160.

The central shaft 136 extends along a central axis of the apparatus 100. A first end of the central shaft 136 is coupled to the first epicyclic arm 110, and a second end of the central shaft 136 is coupled to the second epicyclic arm 120. The first end of the central shaft 136 is coupled to the first central wheel 116 (to the centre of the first central wheel 116), and the second end of the central shaft 136 is coupled to the second central wheel 126 (to the centre of the second central wheel 126). Each of the connection wheel and the central wheel are arranged on the first body 111. The first body 111 extends from a central end to a connection end. The first central wheel 116 is coupled to the body at the central end and the first connection wheel is coupled to the first body 111 at the connection end. The connection wheel is separated from the central wheel on the first body 111. The connection wheel is coupled to the central wheel via the first belt 117.

The first pedal crank arm connection 112 is arranged away from the central axis (and central shaft 136). The first pedal crank arm connection 112 is located at the connection end of the first epicyclic arm 110. The first pedal crank arm 113 is coupled to the first pedal crank arm connection 112 (as shown in FIGS. 1*a* to 1*e*). The first pedal crank arm 113 is coupled to the first connection wheel (to the centre of the first connection wheel). The first pedal crank arm 113 extends away from where it is coupled to the first pedal crank arm connection 112 to a distal end, where the first pedal 114 is located. The first connection wheel and the first central wheel 116 are both circular, and the first belt 117 is arranged to run along some of the circumference of each wheel to couple the two wheels. The two wheels may be the same diameter.

The arrangement of the second epicyclic arm 120 corresponds to that described above for the first epicyclic arm 110, and so shall not be described again here. The second epicyclic arm 120 extends away from the central axis (and central shaft 136) in the same direction as the first epicyclic arm 110. That is, the first epicyclic arm 110 is aligned with the second epicyclic arm 120. For example, when viewed in plan (as in FIG. 1*a*), the two arms extend in the same direction. The second epicyclic arm 120 is arranged so that the second pedal crank arm connection 122 is aligned with the first pedal crank arm connection 112. That is, the first and second pedal crank arm connections 121, 122 are located at the same radial distance away from the central axis, and they extend away at the same angle (when viewing both from the same position (e.g. from a first side of the apparatus 100 or a second side of the apparatus 100).

Figure 1C:
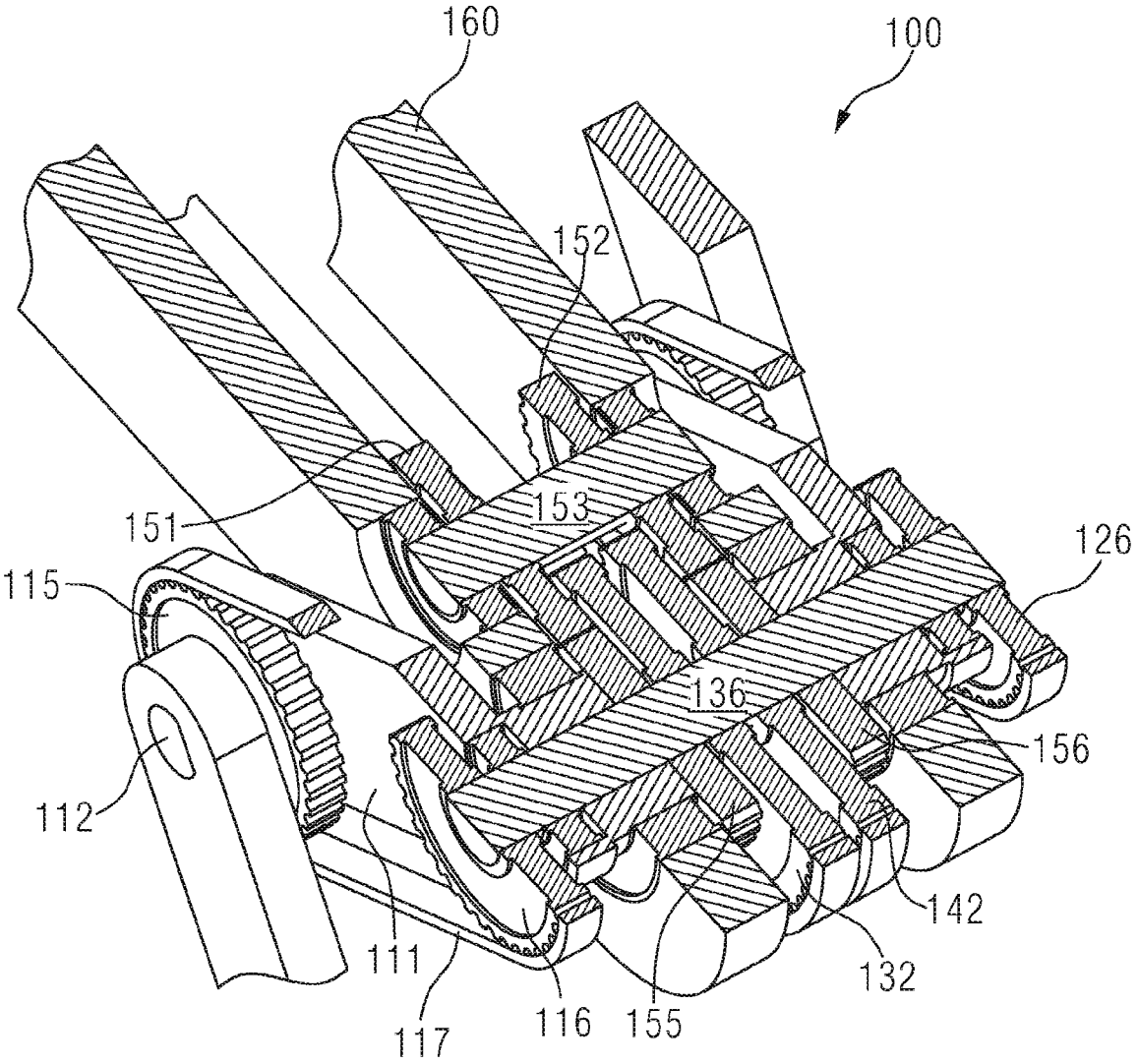

As can be seen best with reference to FIG. 1*c*, the central shaft 136 runs from its first end (where it is coupled to the first epicyclic arm 110) to its second end (where it is coupled to the second epicyclic arm 120). The resistance wheel 132 and the driving wheel 142 are arranged about the central shaft 136 between the first and second end. The first and second transmission wheels 155, 156 are also arranged about the central axis between its first and second end. As shown in FIG. 1*a*, the central shaft 136 extends through the first connection wheel, then the first body 111, then into the housing 160, where it passes through the first transmission wheel 155, then the resistance wheel 132, then the driving wheel 142, then the second transmission wheel 156. The central shaft 136 then passes out through the housing 160, through the second body 121 and into the second central wheel 126. The first connection wheel, the second connection wheel and the resistance wheel 132 are coupled to the central shaft 136. The first and second body 111, 121, the transmission wheels and the driving wheel 142 are separated from the central shaft 136 (e.g. by one or more bearing interfaces). Likewise, one or more bearing interfaces may separate the resistance wheel 132 from the driving wheel 142 and first transmission wheel 155. The resistance and driving wheels may be bigger than the transmission wheels.

The breakout shaft 153 runs along a breakout axis. The breakout axis is offset (e.g. located away) from the central axis. The breakout axis runs parallel to the central axis. The first and second breakout wheels 151, 152 are provided on the breakout shaft 153. The breakout shaft 153 is coupled to the housing 160 (e.g. via a bearing interface). The first breakout wheel 151 is aligned with, and coupled to, the first transmission wheel 155. The second breakout wheel 152 is aligned with, and coupled to, the second transmission wheel 156. The first and second breakout wheel 151, 152 are arranged away from each other on the breakout shaft 153. The resistance and/or driving wheel extend into the space between the first and second breakout wheel 151, 152. The resistance wheel 132 is arranged to not contact the breakout wheels and shaft.

Figure 2A:
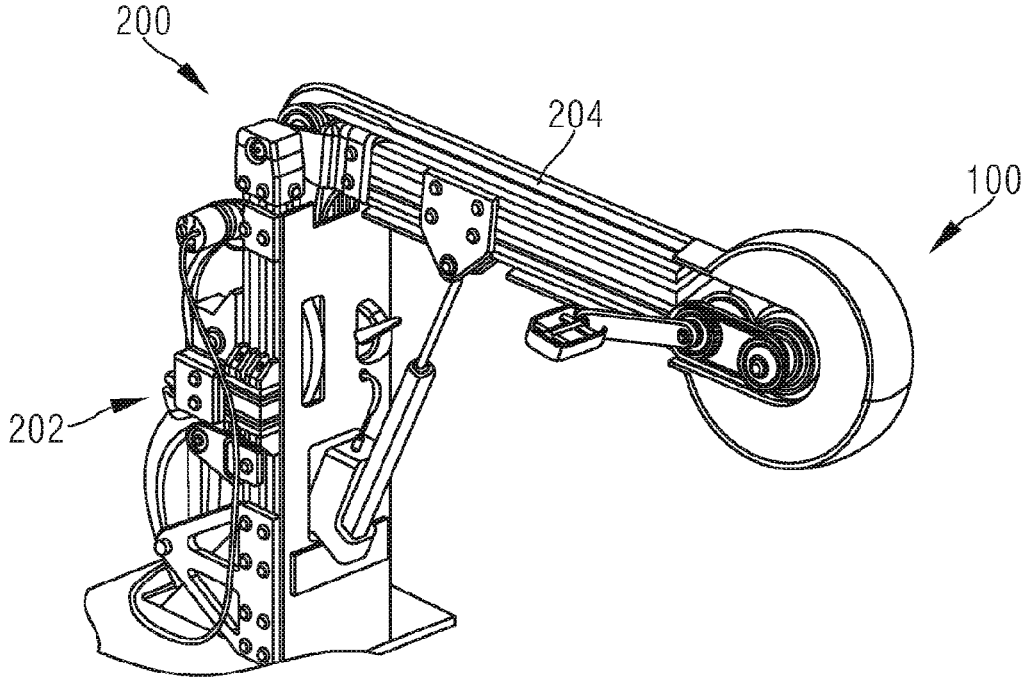
FIGS. 2*a* and 2*b* show schematic diagrams of an exemplary exercise apparatus.
Figure 2B:
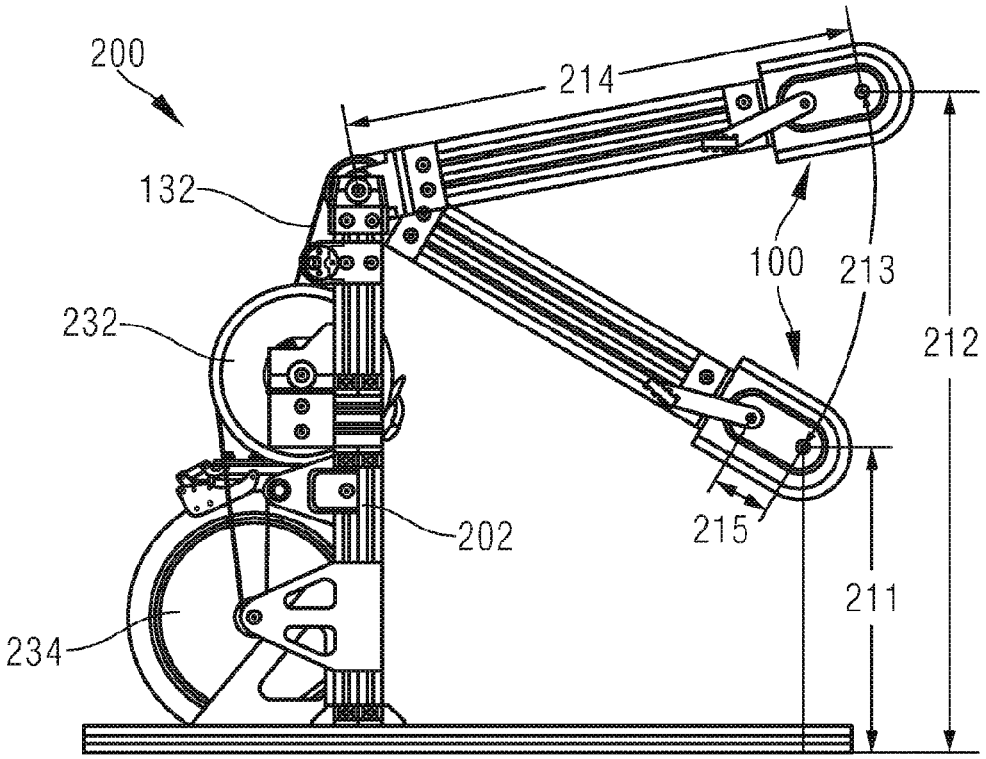

The resistance wheel 132 is coupled to the resistance belt 134. The resistance wheel 132 is circular, and the resistance belt 134 runs along a portion of the circumference of the resistance wheel 132. The resistance belt 134 extends away from the resistance wheel 132. At one end, the resistance belt 134 is coupled to the resistance wheel 132, and at the other end the resistance belt 134 may be coupled to a resistance providing mechanism, such as a flywheel and/or brake. For example, FIGS. 2*a* and 2*b* show a coupling to a flywheel and/or eddy current brake for the resistance belt 134.

The driving wheel 142 is coupled to the driving belt 144. The driving wheel 142 is circular, and the driving belt 144 runs along a portion of the circumference of the driving wheel 142. The driving belt 144 extends away from the driving wheel 142. At one end, the driving belt 144 is coupled to the driving wheel 142, and at the other end the driving belt 144 may be coupled to a driver, such as a motor. The driving wheel 142 is also coupled to the second transmission wheel 156 (as shown best in FIG. 1*c*). For example, a second side of the driving wheel 142 may be attached to a first side of the second transmission wheel 156 (or the two may be arranged to interact with each other and/or be integral components). The second transmission wheel 156 is also coupled to the second body 121. As shown in FIG. 1*c*, a portion of material from the second transmission wheel 156 extends through a hole in the housing 160, where it is coupled to the second body 121. The first transmission wheel 155 (and also the driving wheel 142) are laterally offset from the resistance wheel 132 (they are not in contact). A portion of material from the first transmission wheel 155 extends through a hole in the housing 160, where it is coupled to the first body 111.

The central wheels, the transmission wheels, the resistance wheel 132, and the driving wheel 142 are all co-axial (along the central axis). The coupling between the first transmission wheel 155 and the first body 111 may be annular, and it may extend around the circumference of the central shaft 136. Likewise, the coupling between the second transmission wheel 156 and the second body 121 may be annular, and it may extend around the circumference of the central shaft 136.

Although not shown much in FIGS. 1*a* to 1*e*, the housing 160 encapsulates the apparatus 100 in several regions. The middle part of the apparatus 100 (between the two epicyclic arms, so breakout wheels, breakout shaft 153, resistance and driving wheels, their respective belts, and the transmission wheels) are housed within the housing 160. At the first and second side of the housing 160 a hole is provided through which the central shaft 136 passes, as does the coupling between transmission wheel and body. Each epicyclic arm may also be sealed by a portion of the housing 160. To illustrate the mechanism involved, the housing 160 is generally not shown in FIGS. 1*a* to 1*e*, but it can be seen more clearly in FIGS. 2*a* and 2*b* (in FIG. 2*b* a portion of the housing 160 covering the epicyclic arm is also shown). The housing 160 encapsulates the rotating parts of the apparatus 100. The housing 160 may be provided with a wipe-clean surface.

The apparatus 100 is configured to enable pedalling of the pedal crank arms for exercise. As will be discussed in more detail below, the apparatus 100 is arranged to enable two relevant motions to occur during use of the pedalling apparatus 100. The apparatus 100 is configured to enable these two motions to occur independently or simultaneously.

The first motion the apparatus 100 is configured to enable is a pedalling motion of the first and second pedal crank arms 113, 123 about first and second spindle axes respectively. For the following description, the apparatus 100 is arranged so that the first and second spindles axes are coaxial, i.e. they share a common spindle axis. That is, the apparatus 100 is arranged to enable the two pedal crank arms to be pedalled (e.g. rotationally driven) about the same spindle axis. The apparatus 100 is arranged to ensure pedalling of the first pedal crank arm 113 is in sync with pedalling of the second pedal crank arm 123. In other words, the apparatus 100 is arranged so that the two pedal crank arms operate together (e.g. pedalling of only one crank arm will cause the other crank arm to rotate), and so that the first pedal crank arm 113 is always 180° out of phase with the second pedal crank arm 123. The apparatus 100 is also arranged to provide resistance to this pedalling about the common spindle axis. For example, the apparatus 100 may provide a selectively variable resistance to pedalling of the pedal crank arms about the common spindle axis.

The second motion the apparatus 100 is configured to enable is a movement of the common spindle axis about which the pedal cranks may be pedalled. Each epicyclic arm is arranged to space its pedal crank arm connection away from the central axis, so that the spindle axis is different to the central axis. Each epicyclic arm is configured to rotate about the central axis. Rotation of the epicyclic arms (about the central axis) will cause corresponding movement of this common spindle axis. The pedalling apparatus 100 is configured so that the common spindle axis may move in a circular manner, e.g. the common spindle axis could be located at any point on the circumference of the circle which the movement of the epicyclic arms moves it through. The circle being a circle having a radius defined as the distance between the central axis and the spindle axis (the pedal crank arm connections). The apparatus 100 is arranged to enable a circular pedalling motion to be provided about each point on the circumference of this circle.

The first and second epicyclic arms 110, 120 are coupled to each other so that they rotate together about the central axis. The apparatus 100 is configured so that the first epicyclic arm 110 is always in phase with the second epicyclic arm 120. In other words, the two arms are coupled to each other to constrain their respective rotation about the central axis so that the first and second spindle axes are always coaxial. The apparatus 100 is arranged to select the position on the circle about which the pedalling motion occurs.

The pedalling apparatus 100 may be configured so that the second motion (movement of the common spindle axis) may be controlled to select the position (or positions) at which the first motion (pedalling about the spindle axis) occurs. This functionality will now be described in more detail with reference to FIGS. 1*a* to 1*e*.

The first pedal crank arm 113 is configured to rotate about the common spindle axis in response to pedalling. The first pedal crank arm connection 112 is configured to enable the first pedal crank arm 113 to rotate about its spindle axis relative to the first epicyclic arm 110 to which it is coupled. The first pedal crank arm connection 112 may comprise a bearing assembly to permit relative rotation between the first pedal crank arm 113 and the first body 111. In the example shown in FIGS. 1*a* to 1*e*, the first pedal crank arm 113 is coupled to the first connection wheel. The first connection wheel is arranged to rotate relative to the first body 111. In other words, the first pedal crank arm connection 112 comprises the first connection wheel. The first connection wheel is arranged to rotate in response to pedalling of the first pedal crank about the spindle axis. The first connection wheel is coaxial with the spindle axis, so that the first connection wheel will rotate about the spindle axis in response to pedalling of the first pedal crank about the spindle axis.

The first epicyclic arm 110 is arranged to transmit rotational motion between the first pedal crank arm 113 and the central shaft 136. The second epicyclic arm 120 is arranged to transmit rotational motion between the second pedal crank arm 123 and the central shaft 136. The apparatus 100 is thus arranged to transmit rotational motion between the first and second pedal crank via the central shaft 136. The shaft is also coupled to resistance means to provide resistance to this rotational motion of the shaft (and thus the pedalling motion of the first and second pedal crank arms 113, 123).

The first belt 117 is configured to rotationally couple the first pedal crank arm 113 to the central shaft 136. In particular, the first belt 117 is configured to rotationally couple the first connection wheel and the first central wheel 116. The first belt 117 is arranged so that rotation of the first connection wheel (e.g. in response to pedalling) will be transmitted into rotation of the first belt 117. The first belt 117 is arranged to transmit its rotation into rotation of the first central wheel 116. In other words, the first connection wheel, the first belt 117, and the first central wheel 116 are arranged to rotate together. The first central wheel 116 is coupled to the central shaft 136 so that the two are arranged to rotate together (about the central axis). The first epicyclic arm 110 is arranged so that pedalling of the first pedal crank arm 113 about the spindle axis will cause the central shaft 136 to rotate about the central axis. Likewise, the first epicyclic arm 110 is arranged so that rotation of the central shaft 136 about the central axis will cause rotation of the first pedal crank arm 113 about the spindle axis.

The second epicyclic arm 120 is arranged in the same manner as the first epicyclic arm 110. That is, the second epicyclic arm 120 is arranged so that rotation of central shaft 136 about the central axis will cause rotation of the second central wheel 126 about the central axis. This rotation of the second central wheel 126 will cause the second belt 127 and second connection wheel to rotate. In turn, this causes the second pedal crank arm 123 to rotate about the spindle axis. By the same mechanism, pedalling of the second crank arm about the spindle axis will cause rotation of the central shaft 136 about the central axis.

The apparatus 100 is arranged so that the first and second pedal crank arms 113, 123 rotate together (e.g. 180° out of phase with each other). That is, the first and second epicyclic arms 110, 120 are coupled to each other to enable rotational motion of one pedal crank arm about the spindle axis to be transmitted to the other pedal crank arm (e.g. to provide rotational motion of the other pedal crank arm about the spindle axis.

As set out above, the pedalling apparatus 100 is arranged so that pedalling of the apparatus 100 will cause the central shaft 136 to rotate about the central axis. The apparatus 100 is arranged to provide resistance to this rotational movement (e.g. to provide selectively variable resistance to pedalling of the apparatus 100). The resistance wheel 132 is coupled to the central shaft 136 so that the resistance wheel 132 rotates with the central shaft 136 about the central axis. The resistance belt 134 is arranged to couple the resistance wheel 132 to an additional resistance element. The resistance belt 134 is arranged to rotate with the resistance wheel 132. The resistance belt 134 is also coupled to the additional resistance element, which may provide increased resistance to rotation of the resistance belt 134 (and thus rotation of the resistance wheel 132, the central axis and the pedalling motion). The additional resistance element may comprise a flywheel, or some form of brake, such as an eddy current brake. The additional resistance element may be configured to provide a selectively variable amount of additional resistance to the rotation of the resistance belt 134 by varying a moment of inertia to be rotated by the rotation belt. Operation of the additional resistance element may be controlled to provide a selected amount of resistance to pedalling of the apparatus 100.

The pedalling apparatus 100 is therefore arranged to enable pedalling of the two pedal crank arms about a common spindle axis. The pedalling apparatus 100 may also be arranged to apply a resistance (e.g. a selectively variable resistance) to this pedalling motion.

As can be seen best in FIG. 1*c*, the central shaft 136 is coupled to the resistance wheel 132, and the first and second central wheels 116, 126. However, the first and second bodies 111, 121, the first and second transmission wheels 155, 156, and the driving wheel 142 are separated from the central shaft 136. For example, a bearing interface may be provided between said components, or they may be manufactured to enable the gap to be present and for the components to still rotate about the central axis.

The first and second bodies 111, 121, the transmission wheels, the driving wheel 142, the breakout wheels, and the breakout shaft 153 are arranged to rotate independently of the central shaft 136. That is, the apparatus 100 is arranged so that rotation of the central shaft 136 will not cause said components to rotate. Likewise, rotation of said components will not cause the central shaft 136 to rotate. Pedalling of the pedal crank arms may occur without causing movement of the epicyclic arms.

The apparatus 100 is configured to constrain movement of the epicyclic arms so that if one epicyclic arm is moved, the other epicyclic arm will also be moved in the same fashion. In particular, the apparatus 100 is arranged so that the rotational position of the first epicyclic arm 110 about the central axis will be the same as the rotational position of the second epicyclic arm 120 about the central axis. In other words, the apparatus 100 is configured to constrain the first and second epicyclic arms 110, 120 to extend from the central axis at the same angle (e.g. so that the first and second spindle axis remain coaxial).

The first and second body, 111, 121, the transmission wheels, breakout wheels and breakout shaft 153 are arranged so that the first and second epicyclic arm 110, 120 extend from the central axis at the same angle. For example, the epicyclic arms extending at the same angle may comprise the epicyclic arms being arranged so that the first and second spindle axes are the same.

The first pedal crank arm connection 112 is arranged to enable the first pedal crank arm 113 to rotate about the spindle axis and relative to the first body 111. The spindle axis may run through the first pedal crank arm connection 112 (and through the first body 111 towards the second body 121 and the second pedal crank arm connection 122). The first body 111 carries the first pedal crank arm connection 112. The first body 111 is arranged to rotate the first pedal crank connection (and thus the spindle axis) about the central axis (i.e. if the first body 111 rotates about the central axis, so too will the spindle axis). The first body 111 is coupled to the first transmission wheel 155 so that the two rotate together (about the central axis). That is, rotation of the transmission wheel about the central axis will cause rotation of the first body 111 about the central axis (and vice-versa).

The first transmission wheel 155 is also coupled to the first breakout wheel 151. The two are arranged to be rotationally engaged, so that rotation of one wheel will cause a rotation of the other wheel. The first transmission wheel 155 is arranged to rotate about the central axis. The first breakout wheel 151 is arranged to rotate about the breakout axis. The first transmission wheel 155 and the first breakout wheel 151 are arranged to transmit rotation therebetween, so that rotation of the first breakout wheel 151 about the breakout axis will cause rotation of the first transmission wheel 155 about the central axis (and vice-versa). The first transmission wheel 155 and the first breakout wheel 151 are arranged to offset the axis of rotation. That is, the two are arranged to transmit rotation about one axis into a corresponding rotation about another axis.

The breakout shaft 153 is arranged to be separated from the central shaft 136 by a distance greater than the diameter of the resistance and/or driving wheels. The breakout shaft 153 is coupled to the first breakout wheel 151 so that the two rotate together about the breakout axis. The breakout shaft 153 is also coupled to the second breakout wheel 152 so that the two rotate together about the breakout axis. The second breakout wheel 152 and the second transmission wheel 156 are arranged in the same manner as the first breakout wheel 151 and the first transmission wheel 155. That is, the second breakout wheel 152 and the second transmission wheel 156 are arranged to transmit rotation therebetween (e.g. between rotation of the second breakout wheel 152 about the breakout axis and rotation of the second transmission wheel 156 about the central axis). The two are arranged to offset the axis of rotation. The second transmission wheel 156 is coupled to the second body 121 in the same way as for the first transmission wheel 155 and the first body 111. That is, the second body 121 is coupled to the second transmission wheel 156 so that the two rotate together about the central axis.

The apparatus 100 is arranged so that the first and second epicyclic arm 110, 120 rotate about the central axis together. In other words, the apparatus 100 is arranged so that rotation of the first epicyclic arm 110 will also cause rotation of the second epicyclic arm 120 (and vice-versa). The first and second epicyclic arms 110, 120 are rotationally fixed with respect to each other. The apparatus 100 is arranged to transmit rotation of the first epicyclic about the central axis into rotation of the second epicyclic arm 120 (and vice-versa) via a rotation about a different axis offset from the central axis. The different axis being offset may enable the central axis to rotate to transmit rotational motion between the two pedal crank arms and/or the resistance wheel 132. The different axis being offset from the central axis may enable the epicyclic arms to rotate about the central axis together, as well as to enable pedalling of the first pedal crank arm 113 to be coupled to pedalling of the second pedal crank arm 123. The apparatus 100 is configured to enable two different forms of rotational movement to be transmitted between the two epicyclic arms: (i) rotation of the arms themselves about the central axis, and (ii) rotation of the pedal crank arms about the spindle axis.

The pedalling apparatus 100 is arranged to move the position of the spindle axis. The apparatus 100 is operable to selectively cause rotation of the epicyclic arms about the central axis (e.g. to rotate the position of the spindle axis about the central axis). The apparatus 100 may move the spindle axis to a selected location by controlling the rotation of the epicyclic arms about the central axis.

The driving wheel 142 is also coupled to one of the transmission wheels (or breakout wheels). In the example shown in FIGS. 1*a* to 1*e*, the driving wheel 142 is coupled to the second transmission wheel 156 so that the driving wheel 142 and the second transmission wheel 156 rotate together about the central axis. As such, the apparatus 100 is arranged so that for the epicyclic arms to rotate about the central axis (and move the spindle axis), the driving wheel 142 must also rotate about the central axis. Likewise, the apparatus 100 is arranged so that rotation of the driving wheel 142 about the central axis will cause rotation of the epicyclic arms about the central axis.

The driving wheel 142 may be coupled to a driver via the driving belt 144. The driving belt 144 is configured to transmit rotation between the driver and the driving wheel 142. The driver may be configured to apply a selective force (torque) to the driving belt 144 to control rotational movement of the driving wheel 142. The driver may be operable to either hold the epicyclic arms in a fixed position (e.g. at a fixed angle relative to the central axis), or to move the epicyclic arms into a different position (e.g. at a different angle relative to the central axis). The driver may be configured to apply a stationary torque/resistance to the driving belt 144 to inhibit any rotation of the driving wheel 142 (e.g. a torque/resistance sufficient to retain the driving wheel 142 stationary—to inhibit rotation of the driving wheel 142 about the central axis). This will hold the epicyclic arms in a fixed position. The driver may be configured to apply a moving torque to the driving belt 144 to cause rotation of the driving wheel 142 (e.g. a torque sufficient to provide rotation of the driving wheel 142 about the central axis). The driver may be configured to apply this moving torque to continuously vary the position of the spindle axis, or to provide a discrete movement of the spindle axis from one position to another position, where the spindle axis is then held fixed.

The pedalling apparatus 100 is therefore arranged so that the first and second epicyclic arm 110, 120 move together (e.g. rotate about the central axis together). This may enable the spindle axis about which the first pedal crank arm 113 rotates to always be coaxial with (i.e. the same as) the spindle axis about which the second pedal crank arm 123 rotates. The pedalling apparatus 100 may also be arranged to control movement of the common spindle axis, e.g. to select the position at which the common spindle axis is to be located.

The pedalling apparatus 100 may thus be configured to enable pedalling motion of the pedal crank arms about a common spindle axis, where the position of that common spindle axis may be varied. The apparatus 100 may enable a variable resistance to be applied to pedalling about the common spindle axis (irrespective of the location of the common spindle axis). The apparatus 100 may selectively control (e.g. vary) the position of the common spindle axis about which the pedal crank arms are to be pedalled.

Operation of the pedalling apparatus 100 will now be described with reference to FIGS. 1*d* and 1*e*, which show two different operating positions for the apparatus 100.

Figure 1D:
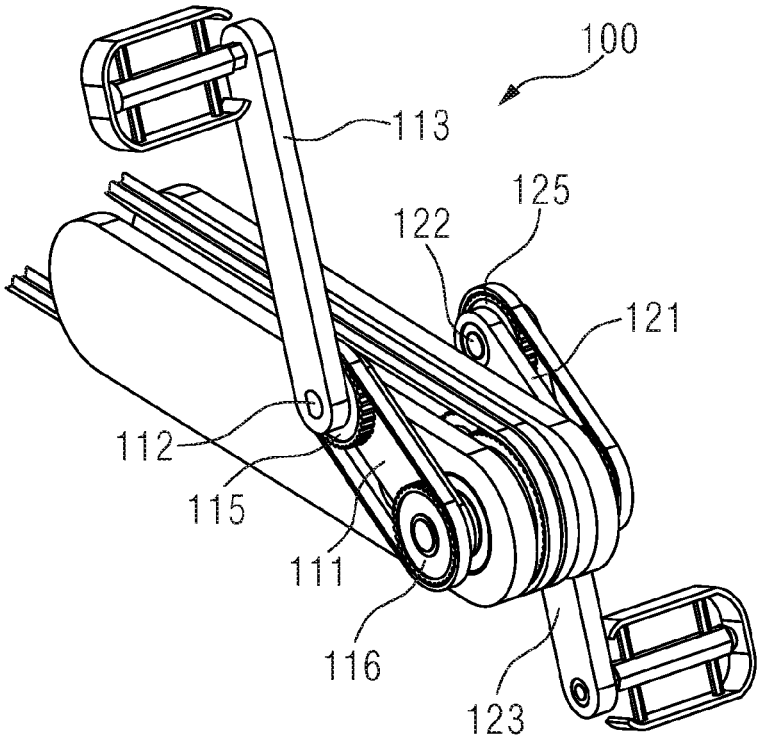
Figure 1E:
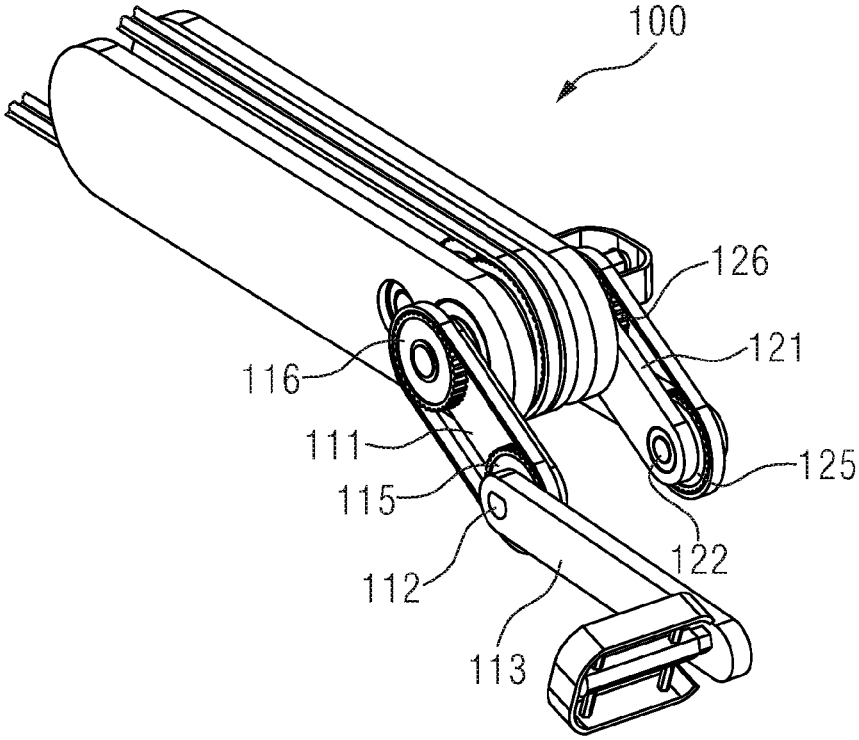

As shown in FIG. 1*d*, the first and second epicyclic arms 110, 120 are at about a 10 o'clock position when viewed from the right-hand side of the apparatus 100 (which in this case corresponds to the first side). The user places their feet on the pedals and starts pedalling. Specifically, the user will pedal the first and second pedals to drive rotation of the first and second pedal crank arms 113, 123 around the common spindle axis. This rotation of the pedal crank arms about the spindle axis will cause the first and second connection wheels to rotate about the spindle axis. The connection wheels are engaged with their respective belt so that this rotation of the connection wheel causes rotation of the belt (as the belt is carried round the surface of the connection wheel with this rotation). Each belt is also engaged with its respective central wheel so that rotation of the belt causes the central wheel to rotate. Therefore, as the user pedals the pedal crank arms about the common spindle axis, this rotation is transmitted into rotation of the connection wheel, which rotates the belt and also the central wheel. Rotation of each central wheel will cause the central shaft 136 to rotate about the central axis.

Pedalling the pedal crank arms about the spindle axis therefore causes the central shaft 136 to rotate about the central axis. This rotation of the central shaft 136 about the central axis is common to both pedal crank arms so that if the user stops pedalling with one leg, but carries on pedalling with the other leg, then both pedal crank arms will keep turning (e.g. so that they are always 180° out of phase with each other).

The user may select a resistance level to be applied to their pedalling motion. To provide the selected resistance, the external resistance element (e.g. flywheel/brake) is coupled to the resistance belt 134 to provide the selected amount of resistance to rotation of the resistance wheel 132. As the resistance wheel 132 is also coupled to the central shaft 136 to rotate with it, the resistance applied to the resistance wheel 132 will also be applied to the pedalling motion about the spindle axis. Thus, the user may pedal about the spindle axis (at the 10 o'clock position) with a selected amount of resistance to this pedalling motion.

Additionally, the user may also select the position at which they are to pedal. In FIG. 1*d*, the common spindle axis is located at approximately the 10 o'clock position, whereas in FIG. 1*e*, the common spindle axis has moved to the four o'clock position. To provide this change in position, a torque is applied to the driving wheel 142 to cause it to rotate. For example, the driver (e.g. a motor) applies a torque to the driving belt 144, which causes the driving belt 144, and thus driving wheel 142, to rotate (about the central axis).

Rotation of the driving wheel 142 causes the second transmission wheel 156 to also rotate (the two rotate together. This rotation of the second transmission wheel 156 about the central axis will cause a corresponding rotation of the second body 121 (and thus second epicyclic arm 120) about the central axis. The driver is operated so that the driving wheel 142 rotates until the epicyclic arms are at their desired position (e.g. so that the corresponding rotation of the epicyclic arms moves the spindle axis to its selected location).

At the same time, the rotation of the second transmission wheel 156 about the central axis will cause the second breakout wheel 152 to rotate about the breakout axis. This will cause the breakout shaft 153 and the first breakout wheel 151 to also rotate about the breakout axis. Rotation of the first breakout wheel 151 about the breakout axis will cause the first transmission wheel 155 to then rotate about the central axis. This transmission between the first and second transmission wheels 155, 156 is arranged so that the first and second transmission wheel 155, 156 will have the same rotation about the central axis. In other words, the first transmission wheel 155 rotates about the central axis in the same manner as the second transmission wheel 156, but this rotational movement is transmitted between the two transmission wheels via the breakout wheels (and breakout shaft 153), e.g. via rotation about the breakout axis. Rotation of the first transmission wheel 155 about the central axis will cause a corresponding rotation of the first body 111 (and thus first epicyclic arm 110) about the central axis. The first epicyclic arm 110 will therefore also rotate about the central axis with the second epicyclic arm 120, until they are arranged so that the common spindle axis is at the selected position (which as shown in FIG. 1*e* is at the 4 o'clock position).

Once the epicyclic arms have been moved (rotated) so that the common spindle axis is in the selected location, the driver is operated to inhibit any further rotation of the driving wheel 142. For example, a high resistance (or resistive torque) may be coupled to the driving wheel 142 (via the driving belt 144), so that further rotation of the driving wheel 142 does not occur. As such, the position of the common spindle axis will remain stationary.

The user may continue pedalling as the common spindle axis moves. They may then continue pedalling once the movement has stopped and the common spindle axis is in a different location. The apparatus 100 therefore enables epicyclic pedalling to occur. It will be appreciated in the context of the present disclosure that an epicyclic pedalling motion comprises a pedalling motion based on two different circular trajectories. The first trajectory is a circular trajectory about a given point (a spindle axis), which is brought about as the pedal crank arms rotate about the spindle axis. The second trajectory is a circular, or partially circular (e.g. along a section of a circle), trajectory where the spindle axis itself moves by rotating about a central axis. The result being that a circular pedalling motion (about a spindle axis) may be provided at any point along the circumference of another circle (about a central axis).

As set out above, the pedalling apparatus 100 may be operated to enable a variable resistance pedalling motion (about a spindle axis) to occur, where that spindle axis itself may be moved (rotated about a central axis). A few examples of how this apparatus 100 may be controlled will now be described (e.g. examples of how the resistance may be controlled and/or how the location of the spindle axis may be controlled).

A controller may be provided which is configured to receive one or more signals for the pedalling apparatus 100. The controller may be configured to control operation of the pedalling apparatus 100 based on such input signals. The controller may be configured to receive one or more input signals indicative of operation of the pedalling apparatus 100 and/or a status of the user pedalling the pedalling apparatus 100. The controller may be configured to control operation of the pedalling apparatus 100 based on the one or more input signals. The controller may be configured to vary the pedalling resistance based on the input signal. The controller may be configured to vary the position of the spindle axis based on the input signal (e.g. to vary the rotational position of the epicyclic arms). The controller may be configured to send an output signal to external componentry. The output signal may be configured to provide an indication of the operation of the pedalling apparatus 100. For example, the output signal may cause relevant information to be displayed on a display (e.g. a television screen or a virtual reality headset).

The input signals to the controller may provide an indication of the status of the person exercising, or of the exercise itself (e.g. the operation of the apparatus 100). An input signal indicative of the status of the person exercising may comprise a signal indicative of any of their: heart rate, blood pressure, blood glucose levels, rate of perceived exertion, and/or any other property indicative of the impact of the pedalling exercise on their body. An input signal indicative of an operational characteristic of the pedalling apparatus 100 may comprise a signal indicative of any of: a pedalling power (power input into the apparatus 100 through the user's pedalling), cadence (number of revolutions of the pedal cranks per unit time), a force/torque being applied to the pedals, any left-right imbalance in pedalling (e.g. power/torque difference being applied to the left and right pedals), and/or any other property indicative of how well (or not) the user is pedalling the apparatus 100, and/or how that may vary over time. The input signals may also include signals indicative of an input from a user of the pedalling apparatus 100 (e.g. from someone pedalling the apparatus 100). For example, the user may input a signal indicative of: a selected resistance (or a selected change to the resistance), and/or a selected position for the spindle axis (or a selected movement of the spindle axis).

The controller may be configured to operate in a plurality of different modes. In each mode, the controller may be configured to control operation of the pedalling apparatus 100 in a slightly different way. In general, the controller may be configured to control operation of the pedalling apparatus 100 by controlling the resistance applied to the pedalling motion, and/or by controlling the position of the common spindle axis. How the controller controls these properties of the pedalling apparatus 100 may vary depending on the mode in which the controller is operating.

Three exemplary modes of operation for the controller will be described in detail below. These are: (i) a reactionary mode, (ii) a structured exercise mode, and (iii) an interactive mode. In the reactionary mode, the controller is configured to control operation of the pedalling apparatus 100 based on one or more input signals. In the structured exercise mode, the controller is configured to control operation of the pedalling apparatus 100 according to a pre-scheduled plan (e.g. an exercise plan for the pedalling of the apparatus 100). In the interactive pedalling mode, the controller may be configured to control operation of the pedalling apparatus 100 based on properties of a virtual environment and/or a digital avatar moving in that virtual environment.

In the reactionary mode, the controller is configured to control operation of the pedalling apparatus 100 based on one or more input signals. The input signals may fall into one of two categories: (i) a signal indicative of a requested resistance/spindle axis position, and (ii) a signal indicative of the status of the person exercising, or of the exercise itself.

In the first case, the controller is configured to obtain a signal indicative of a desired resistance and/or spindle axis position, and to control operation of the pedalling apparatus 100 based on this obtained signal. For resistance, the request may comprise an indication to increase resistance, to decrease resistance and/or to provide a selected resistance level. For example, the apparatus 100 may be arranged to enable a user to interact with the controller to vary the resistance being applied (e.g. so that a user may decrease resistance when tired, or to increase resistance if feeling good). For spindle axis position, the request may comprise an indication to move the spindle axis in a first or second direction (e.g. to rotate the spindle axes clockwise or counter-clockwise), and/or to move the spindle axis to a selected location. For example, a user may provide an input signal which requests that movement of the spindle axis is controlled to vary which muscles are being used to pedal the apparatus 100 (e.g. moving the spindle axis further away from the person pedalling, such as further away from their hips, may engage glute and core muscles more than when the spindle axis is closer to them, and when quadriceps dominate the pedalling motion). In other words, the controller may be configured to control operation of the pedalling apparatus 100 as per the request from the user in the input signal.

In the second case, the controller is configured to obtain a signal indicative of the status of the person exercising and/or the status of the exercise itself, and to control operation of the pedalling apparatus 100 based on this obtained signal. Based on the obtained signal, the controller may be configured to make pedalling of the apparatus 100 more difficult in the event that the obtained signal indicates that it is likely the user is capable of the increased difficulty (e.g. if the user is not currently struggling to pedal), and/or to make pedalling of the apparatus 100 easier in the event that the obtained signal indicates that it is likely that the user is not capable of sustaining the current pedalling (e.g. if the user is struggling to pedal).

To increase difficulty of pedalling, the controller is configured to increase resistance of the pedalling motion. The controller may also be configured to move the spindle axis towards a harder pedalling position (typically this will be further away from the user). To decrease difficulty of pedalling, the controller is configured to decrease pedalling resistance and/or move the spindle axis towards an easier pedalling position (towards the user).

In the event that the input signal indicates that the ease of pedalling is below a threshold value, the controller is configured to control operation of the pedalling apparatus 100 to decrease resistance and/or to bring the spindle axis closer towards the user. For example, if the user's heart rate or blood pressure is above a threshold level, the controller may be configured to make pedalling easier—e.g. the controller may decrease resistance, such as to apply no additional resistance to the pedalling motion. Likewise, if the user's heart rate or blood pressure is increasing at above a threshold rate increase, the controller may control operation of the pedalling apparatus 100 to make pedalling easier. The controller may be configured to make pedalling easier in the event that an input signal indicates pedalling output is decreasing (e.g. the cadence or power is below a threshold level, or is decreasing at above a threshold rate). For example, in the event that the input signal indicates that the user is struggling (e.g. based on their heart rate and/or blood pressure, or based on a property of the pedalling dynamics such as cadence or power), the controller may be configured to decrease the resistance applied to the resistance wheel 132 (e.g. to make pedalling easier). Conversely, if the input signal indicates that the user is finding pedalling too easy (e.g. their heart rate is too low), then the controller may be configured to increase the resistance.

The controller may be configured to control resistance as set out above, e.g. so that resistance is decreased if a user is struggling, and/or so that resistance is increased in the event that a user is finding pedalling too easy. Additionally, the controller may be configured to vary the position of the spindle axis. The controller may be configured to move the spindle axis, and to monitor input signals from the user/pedalling apparatus 100 to determine whether or not to further move the spindle axis. For example, the controller may be configured to determine, based on the input signal, whether the user is likely to be able to continue pedalling with further movement of the spindle axis. It is to be appreciated in the context of the present disclosure that if the spindle axis is moved too far away from the user, then they may be unable to continue pedalling satisfactorily. The controller may be configured to determine whether this is the case based on the input signals. For example, in the event that properties of the pedalling indicate that the user is struggling to continue pedalling (e.g. cadence/power/force through pedal is below a threshold value or decreasing at above a threshold rate, and/or a user's heart rate drops below a threshold/starts decreasing at above a threshold rate), the controller may determine that the spindle axis is too far from the user and is impeding their ability to continue pedalling.

The controller may be configured to control movement of the spindle axis so that the spindle axis will be moved back towards the user in the event that the controller determines that the user is struggling to pedal with the spindle axis at that separation. Before this is reached, the controller may be configured to vary the spindle axis position, e.g. the controller may control the spindle position to move away from the user. This may be gradual movement over time, or it may occur in discrete chunks. The controller may be configured to vary the spindle axis position over time (e.g. to vary the muscles being exercised by the user). The controller may be configured to identify if the spindle axis position is causing an issue with pedalling, and in the event that it is, the controller may be configured to control the spindle axis position to return to a position at which the user is no longer struggling so much to pedal. At any point, the controller may be operable to receive an input signal from the user indicating whether they want more or less resistance and/or to move the spindle axis position, and to control operation of the apparatus 100 according to this request from the user.

In the structured exercise mode, the controller may be configured to obtain a pre-selected plan for the pedalling. The pre-selected plan may prescribe the resistance to be applied during the session, and how that resistance varies over the session. For example, a pre-prescribed interval session could be loaded in which higher resistance is applied for some time intervals, and these high resistance intervals are separated by lower resistance intervals. The pre-selected plan may prescribe the location of the spindle axis during the session, and how that location varies over the session. For example, the pre-selected plan may control the pedalling apparatus 100 so that the user starts in a more comfortable pedalling position, but then over time tries to move the user into a position with the pedalling further away from them to engage core/glute muscles more.

The resistance and spindle axis position may be controlled together. The controller may control both the resistance and the spindle axis position at the same time. For example, the controller may control both to mimic standing up (out of the saddle) on a bicycle, e.g. by moving the pedalling apparatus 100 to a position more in line with the user's hips, and optionally increasing the resistance at the same time. The controller may be configured to vary the location of the spindle axis to try to provide desired stretching and/or strengthening of relevant parts of a user's body. For example, moving the spindle axis further away from the user may cause more stretching for them and/or may require the user to engage their core more for the exercise. The pre-prescribed plan may include bursts into further away positions to target the relevant muscles in this way. The controller may be configured to control this motion by moving the spindle axis further away from the user (as per the pre-prescribed plan), but also monitoring the one or more input signals (as described above for the reactionary mode) to ensure the user is still able to provide satisfactory pedalling of the apparatus 100 (e.g. that the spindle axis is not too far away from them).

In the interactive pedalling mode, the controller may operate to provide gamified exercise. A digital avatar may be provided in a virtual exercise environment, and the controller may be configured to vary the resistance and/or spindle axis position based on the terrain over which the avatar is passing. For example, the digital avatar may be a cyclist who is cycling in a virtual environment. The controller may control the resistance based on the terrain over which the digital avatar is cycling, e.g. to increase resistance if the digital cyclist is going uphill or over rougher terrain (e.g. cobbles etc.). The controller may control the position of the spindle axis based on the cycling position of the digital avatar. For example, the controller may be configured to move the spindle axis to a position designed to replicate standing out of the saddle on the bike, or to represent cycling at an incline or decline. The controller may select the relevant position for the spindle axis to correspond to the terrain over which the avatar is cycling in the virtual environment and/or to correspond to whether the avatar is cycling out of the saddle. For example, the controller may be configured to move epicyclic arms forward relative to the user to simulate cycling downhill, and/or to move the epicyclic arms backwards relative to the user to simulate cycling uphill. The pedalling apparatus 100 may be coupled to a display to enable a user to visualise the digital avatar cycling in the virtual environment. For example, this may be displayed on a television, or in a virtual reality headset to be worn by the user pedalling the apparatus 100.

In examples described herein, operation of the apparatus 100 may be controlled to vary a pedalling resistance and/or to vary a location of the pedal spindle axis (e.g. the axis about which the user will be pedalling the pedal crank arms at any one moment in time). Varying the pedalling resistance will vary how hard it is for a user to pedal the apparatus 100. Varying the position of the spindle axis will vary the motion of the user pedalling the apparatus 100. For example, the range of motion for a user's knee or hip joints may vary depending on the position of the spindle axis.

For a conventional exercise bike (e.g. a spinning bike), a user will set a fixed position for their bike (e.g. a fixed saddle height, frame size, and/or crank length), and as long as they remain seated on the saddle, they will pedal about an axis which remains at a fixed distance away (i.e. the pedalling axis is at a fixed displacement from them). Typically, the position for a user on their bike will be selected so that the user's knee joint moves in an angle range of between 90 and 160 degrees, and their hips do not move much (if at all). This position, and range of motion, will be fixed as long as the user remains seated. If they cycle out of the saddle (e.g. standing up on the pedals), then this position will change (i.e. the relative displacement between them and the pedalling axis will change). When standing up on the pedals, a user will typically engage their glute and/or hamstring muscles more than when seated, where pedalling is mainly quad dominated. They will also typically extend their knees slightly more than when seated (e.g. to 170 degrees). This movement is often combined with increased intensity efforts. For example, spinning instructors will have people doing sprints out of the saddle, and professional cyclists will often climb out of the saddle when trying to maximise their power output.

In other words, a user of a conventional exercise bike will always be pedalling in a circular motion about a fixed axis. They can vary the relative displacement between themselves and that fixed axis by moving their position (e.g. sitting down or standing up), but they cannot vary this relative position while pedalling in one location without moving (e.g. while remaining seated). As a result, for a user of a conventional exercise bike to stimulate alternative muscles, such as their glutes or hamstrings, they will need to move themselves relative to their bike. Using these additional muscle groups may prove beneficial for all individuals, but it may not be possible for all people to exercise in this way. When standing out of the saddle and pedalling, a user will experience much more stress through their hands/arms (associated with holding on to the handlebars when out of the saddle), as well as through their legs/knees/hips (associated with bearing weight the saddle would otherwise be bearing). For example, a user with a broken arm may be unable to withstand this stress, and so may be confined only to stationary cycling. Similar comments apply to individuals with other injuries, arthritis etc., whose body cannot support this extra load-bearing stress.

Pedalling apparatuses of the present disclosure may enable a user to exercise these different muscle groups without needing to place excess stress through potentially vulnerable parts of their body. When moving to pedal out of the saddle on a conventional exercise bike (e.g. standing up and moving forwards), the axis about which the user pedals will move backwards relative to the user, as well as further away from them. For pedalling apparatus 100 of the present disclosure, this same relative movement may be achieved without the user moving. That is, the apparatus 100 may be controlled to move the spindle axis away from the user to simulate them standing up out of the saddle (i.e. to target the same muscles which would be targeted by standing up out of the saddle, but without the user having to move). For example, the apparatus 100 may be controlled so that the spindle axis moves backwards relative to the user, and/or further away from them. Thus, the apparatus 100 may be operated to simulate a movement analogous to that of a user standing out of the saddle when pedalling (without the user having to move themselves).

As will be appreciated, the spindle axis may be moved to simulate other pedalling positions. For example, cyclists often move forward on their saddle (without necessarily standing up) when trying to increase power, or when going uphill. Likewise, a user may move backwards relative to their pedalling axis when cycling gets easier (e.g. when going downhill), or when trying to adopt a more aerodynamic position on their bike. These different relative positions could all be achieved by controlling operation of the pedalling apparatus 100 to move the spindle axis relative to the user.

In addition to varying the position of the spindle axis to simulate pedalling in different riding positions, the apparatus 100 may also be configured to vary the resistance in accordance with the riding position. As mentioned above, some riding positions are associated with higher outputs (e.g. higher intensity work), such as when simulating cycling out of the saddle (or at least further forward on the bike). The apparatus 100 may be configured to control resistance to be higher for these higher intensity riding positions, e.g. the resistance may be selected based on a resistance that would be associated with that riding position, such as higher resistance as the spindle axis moves backwards and/or away from the user.

The resistance and spindle axis position may be controlled in combination. That is, the apparatus 100 may be controlled to: (i) move the spindle axis based on a planned resistance, and/or (ii) adjust the resistance based on the position of the spindle axis. For example, an increase in resistance (e.g. pre-planned or ad hoc) may be accompanied by a change in position of the spindle axis to a more powerful position, or vice-versa. For example, a change in position of the spindle axis to a more powerful position may be accompanied by an increase in resistance, or vice-versa. This controlling of both resistance and spindle axis position may be employed in any of the exemplary modes of operation described above. That is, in any of the modes of operation, resistance and spindle axis position may be controlled together so that the two are suitable for each other (e.g. so that higher resistance is applied to more powerful positions). In particular, this combined control of resistance and spindle axis position may find particular utility when operating in the interactive exercise mode.

The apparatus 100 may be controlled to provide gamified cycling by controlling both the resistance and the spindle axis position according to a virtual cycling environment. A user of the apparatus 100 may themselves remain stationary while the position of the spindle axis moves relative to them. The position of the spindle axis may move to simulate the position on the bike in which they would be expected to be cycling in the virtual cycling environment. For example, if simulating cycling uphill, the spindle axis may be moved to simulate the user either moving further forward on their saddle or standing up out of the saddle. A corresponding change to the resistance may also occur based on the cycling in the virtual cycling environment. For example, if simulating cycling uphill, the resistance may also increase, as would be expected with cycling in real life. The apparatus 100 may therefore enable a very real-life simulation of cycling to occur while also enabling the user to remain in a stationary position (apart from their pedalling motion).

Examples described herein relate to controlling movement of the spindle axis while a user is pedalling the apparatus 100. This movement of the spindle axis may occur continuously (e.g. the position of the spindle axis may be continually changing), or this movement may occur in discrete chunks (e.g. the spindle axis may move from a first location to a second location, and the user may then pedal the pedal crank arms about the second location without the second location moving). While the spindle axis remains in a fixed location, the user will pedal in a circular motion about that spindle axis. As the spindle axis moves, the user will then pedal in a different motion, as this will involve pedalling in a circular motion about a central point which is moving. For example, as the spindle axis itself may rotate about the central axis (to provide the movement of the spindle axis), the pedalling motion may trace the path of an epicycloid, as the user pedals in circles about a point moving along the circumference of another circle.

The apparatus 100 may control the spindle axis to move continuously. For example, the apparatus 100 may control the spindle axis to continuously rotate about the central axis. The speed of rotation of the spindle axis about the central axis may be constant, or it may vary. The apparatus 100 may be arranged so that each subsequent pedal stroke is different to the previous pedal stroke. For example, if the spindle axis is moving away from the user (e.g. during that phase of its rotation about the central axis), then the user will be pedalling with their leg further stretched out. This will feel as though their stride length (e.g. one complete pedalling revolution) is lengthening, as the pedal will travel further away from the user during that pedal stroke. For example, an opposite situation may occur if the spindle axis is moving towards the user, as each subsequent pedal stroke will be closer to the user (e.g. their stride length will be decreasing).

Within each pedal stroke, the pedalling motion may change slightly as the spindle axis moves. The apparatus 100 may be operated in this manner so that the spindle axis position continuously changes, thereby continually varying which muscles are engaged when pedalling (e.g. the stride length is continually changing). It is to be appreciated that the spindle axis position may continually change, but that this need not always involve a rotation in the same direction. For example, the apparatus 100 may enable the spindle axis to rotate both clockwise and anti-clockwise about the central axis. The speed at which the spindle axis moves may be selected to provide relatively small changes in spindle axis position with each subsequent position. For example, this may comprise having a high number (e.g. 2 or more, 5 or more, 10 or more etc.) of pedal crank arm revolutions about the spindle axis per one spindle axis revolution about the central axis.

Alternatively, or additionally, the apparatus 100 may control the spindle axis to move in discrete chunks. For example, the apparatus 100 may selectively move the spindle axis between different positions, and then hold the spindle axis constant in each position. A user may pedal in a circular manner about the spindle axis in the first position. Then, the user may keep pedalling while the spindle axis position changes, or they may wait until the spindle axis has moved to the second position. They may then pedal in a circular manner about the spindle axis in the second position. For example, the apparatus 100 may be configured to move the spindle axis after a selected amount of time has elapsed, or a selected number of pedal crank arm revolutions have occurred, while it is in a fixed position.

The apparatus 100 may be configured to control movement of the spindle axis, and how this spindle axis moves (e.g. continuously or discretely) depending on a mode of operation for the apparatus. For example, where it is desired to have one muscle group (or one particular pedalling position) be worked for a selected time period, the spindle axis may be moved in a discrete manner and the spindle axis position will be held constant (when in the desired position). For example, where it is desired to continuously vary the muscle group/pedalling position, the spindle axis position may be moved in a continuous manner, so that this spindle axis position varies as desired (e.g. to change which muscles are used and/or to simulate a certain type of cycling).

The apparatus 100 may be configured to control movement of the spindle axis to simulate corresponding cycling movements which would be experienced in real life. The apparatus 100 may also control the resistance accordingly. The apparatus 100 may be configured to vary the stride length for a user pedalling the apparatus 100, to simulate cycling uphill or downhill (depending on the movement of the spindle axis). For example, a position for the spindle axis may be selected to provide a stride length which feels like cycling downhill (e.g. a larger stride length), or that feels like cycling uphill (e.g. a shorter stride length). The apparatus 100 may be configured to vary the position of the spindle axis accordingly to simulate cycling over varied terrain. For example, the apparatus 100 may be configured to simulate the feeling of gear changes as they would occur on a normal bike. The apparatus 100 may be configured to increase/decrease the resistance based on the gear change (e.g. increase/decrease the resistance by an amount corresponding to the change in resistance that would have occurred with that gear change on a normal bike), and/or to provide a corresponding change to the spindle axis position. Varying the terrain and the gear may be provided in common. For example, the apparatus 100 may enable a user to simulate changing gears as well as simulating the uphill/downhill movement—e.g. to allow a user to select an easier gear for cycling uphill etc.

Examples described herein provide an epicyclic pedalling apparatus 100. A user may pedal the pedal crank arms of the apparatus 100 about a spindle axis. This spindle axis may be moved relative to the user (e.g. rotated about a central axis of the apparatus 100). As a result, the user may be able to pedal in a variety of different positions (where the relative displacement between them and the spindle axis varies). The apparatus 100 may enable a user to exercise a range of different muscle groups (e.g. glutes/hamstrings/core, in addition to their quads) by moving the spindle axis without requiring the user to move themselves. This may have advantages for enabling a user to target different muscles (e.g. to enable more powerful output), as well as enabling a more realistic simulation of real-life cycling, without having to move themselves.

In particular, this functionality of the pedalling apparatuses of the present disclosure may find particular utility for individuals where exercising in a fully load-bearing manner is less likely to be achievable. For example, individuals who are bed-bound would not be able to use a conventional exercise bike. Likewise, individuals who are recovering from injury, or who have upper body issues etc. may be unable to use a conventional exercise bike to full utility, as they are unable to vary their position on a bike. This may impede their ability to exercise properly. The apparatus 100 may enable a user to pedal the apparatus 100 while that user remains in a stationary position. For example, a user could sit in a chair, or they could lie down (in a supine position), and they may be able to remain in that position but pedal the pedalling apparatus 100 and target a variety of different muscle groups. Users could also pedal the pedalling apparatus 100 in a manner which simulates conventional cycling and use of cycling muscles, as would be expected when riding a bicycle in a conventional manner. This may prove particularly useful when helping with rehabilitation, or exercise, for users for whom conventional exercise, such as cycling on a spinning bike in a load-bearing manner, is hard to achieve.

FIGS. 2*a* and 2*b* illustrate an apparatus to facilitate use of pedalling apparatuses described herein. The apparatus shown in FIGS. 2*a* and 2*b* may find utility for providing user's with access to the pedalling apparatus 100 without requiring additional movement of the user to pedal the apparatus. For example, the apparatus may find particular utility for individuals lying on their back (e.g. in bed) who can then pedal the pedalling apparatus 100.

FIGS. 2*a* and 2*b* show an exercise apparatus 200. The exercise apparatus 200 includes the pedalling apparatus 100 described herein. The exercise apparatus 200 includes a stand 202 and a gantry 204. The exercise apparatus 200 includes a flywheel 232, a brake 234, and the resistance belt 134 is also shown in FIGS. 2*a* and 2*b*. Several measurements are shown in FIG. 2*b*. These include a first elevation 211 and a second elevation 212, as well as an elevation separation angle 213, a gantry length 214, and an axial offset length 215.

The stand 202 is coupled to the gantry 204 to elevate the gantry 204 off the ground. A first end of the gantry 204 is coupled to an upper end of the stand 202. The pedalling apparatus 100 is arranged at a second end of the gantry 204. A lower end of the stand 202 may be coupled to a moveable base (e.g. which has wheels). This may facilitate easy transport of the exercise apparatus 200. The stand 202 is also arranged to support the flywheel 232 and/or brake 234. The brake 234 may comprise an eddy current brake. In the example shown in FIGS. 2*a* and 2*b*, the resistance belt 134 is coupled to both the flywheel 232 and the brake 234 (with the other end of the resistance belt 134 coupled to the resistance wheel 132).

The stand 202 is configured to selectively elevate the gantry 204. For example, the stand 202 may be controlled by the controller, or the stand 202 may be coupled to one or more controls which may selectively control the elevation of the gantry 204. The stand 202 is operable to vary the elevation of the gantry 204 above the floor. For example, this may enable the gantry 204 to elevate the pedalling apparatus 100 to a position above a user, e.g. so that the user may pedal while still lying on their back (e.g. in bed). The stand 202 may be controlled so that the pedalling apparatus 100 is elevated to a desired elevation of the user of the apparatus 200.

The stand 202 may be configured to position the pedalling apparatus 100 so that the central axis of the pedalling apparatus 100 is located at a selected height above the ground. As shown in FIG. 2*b*, the stand 202 may be configured to control the height of the gantry 204 to position the central axis at any height between the first elevation 211 and the second elevation 212. The gantry 204 is configured to pivot relative to the stand 202 to provide the different elevation of the central axis above the ground. The gantry 204 may be configured to pivot through the elevation separation angle 213, e.g. to provide the selected height for the pedalling apparatus 100. Also shown in FIG. 2*b* is the gantry length 214, which is the distance separating the central axis of the pedalling apparatus 100 from the gantry 204/stand 202 pivot point (the point about which the gantry 204 pivots relative to the stand 202). The exercise apparatus 200 may be configured to vary this distance. Also shown for illustration is the axial offset length 215, which illustrates the radius for movement of the spindle axis about the central axis (e.g. the distance separating the spindle axis from the central axis).

The resistance belt 134 may couple the resistance wheel 132 to the flywheel 232 and/or the brake 234. Likewise, although not shown, the driving belt 144 may couple the driving wheel 142 to a driver of the exercise apparatus 200. The exercise apparatus 200 may be configured to control operation of the flywheel 232/eddy current brake 234 to increase/decrease the resistance applied to the resistance wheel 132. The exercise apparatus 200 may be configured to control operation of the driver to vary the position of the driving wheel 142 (and thus of the epicyclic arms). This control of the exercise apparatus 200 may be controlled as described above, e.g. by the controller (such as based on one or more input signals).

The exercise apparatus 200 may thus enable the pedalling motion described above to be facilitated for a user lying on their back. The stand 202 and gantry 204 may be operated to raise the pedalling apparatus 100 to a desired location above the user. The user may then start pedalling the pedal crank arms of the apparatus 100 about the spindle axis. The pedalling resistance may be controlled, as may the location of the spindle axis, as described above. For example, the position of the spindle axis may be moved to engage different muscles. Likewise, the resistance may be varied so that the resistance applied may change during pedalling, e.g. so that the user pedals against a higher resistance when in a position which opens up more powerful muscles. As described above, the spindle axis position and the resistance may be controlled together, e.g. to simulate conventional cycling and/or to ensure all relevant muscle groups are targeted accordingly during exercise.

The gantry 204 may hold the pedalling apparatus 100 in a fixed position relative to the user, and the position of the spindle axis may be controlled, as described above, so that the relative displacement between the user and the spindle axis may vary. The gantry 204 may be arranged to provide the pedalling apparatus 100 at an elevated location at which a user may pedal the pedalling apparatus in a supine position (e.g. when lying on their back and pedalling). In this position, their legs may be elevated relative to the rest of their body. Such an elevated position may enable venous and fluid drainage to be improved for the user, and it also removes any bodyweight induced difficulties with pedalling. Thus, enabling a user to pedal with elevated legs (and in a supine position) may prove particularly useful, especially for bed-bound patients who would otherwise be unable to exercise. Furthermore, these people would also be able to not only get some exercise, but they would be able to exercise a large variety of muscle groups by movement of the spindle axis relative to them.

It is to be appreciated that supine pedalling may have benefits for other individuals as well. For example, a user of the apparatus 200 need not use their hands to exercise (unlike on a spinning bike where hands are used to support the user's body weight, especially when cycling out of the saddle). This means a user may use their hands for other activities while still pedalling with their legs, and/or it may enable individuals with hand and/or arm difficulties to exercise a variety of different cycling muscles.

The apparatus 200 may find use in many other circumstances as well. For example, overhead pedalling may enable different muscle groups to be targeted in differing amounts. In such examples, a user may be able to pedal in or close to a reverse crunch position (e.g. with their knees near to directly above their head). In this position, the core would get a very tough workout, much more so than with conventional cycling, as may muscles such as the glutes. Through movement of the pedal spindle axis, the user could do bursts of exercise in this reverse crunch position, then return to a less core-intensive position for recovery (e.g. back towards the supine position with their legs elevated in a less core-demanding position). In such examples, a user may be able to perform high intensity exercise without placing undue stress through injured, or weaker, parts of their body.

In other examples, the pedalling apparatus 100 may be provided as part of a seated exercise apparatus. The seated exercise apparatus would include a chair on which a user sits to pedal. The chair may have arm supports for the user, and it may have some swivel functionality. The pedalling apparatus 100 may be positioned below the seat so that a user may pedal while sat on the chair. The spindle axis may move (as described above) to target different muscles for pedalling—the arm rests and/or swivel functionality may enable a user to achieve the different ranges of motion needed (e.g. for pedalling when more hip/glute movement is involved).

It is to be appreciated in the context of the present disclosure that the description above is not intended to be limiting. Alternative and/or additional features may be included. For example, the examples illustrated in the FIGS. depict a particular structure for the pedalling apparatus 100. However, this particular structure is not to be considered limiting, as other structures may be used to provide similar functionality. The apparatus 100 is configured to enable a user to pedal the pedal a first pedal crank arm 113 about a first spindle axis and a second pedal crank arm 123 about a second spindle axis. The apparatus 100 is arranged to couple the two pedal crank arms, so that rotational motion of one pedal crank arm is transmitted to the other (and vice-versa), e.g. so that rotation of one crank arm about its spindle axis causes a corresponding rotation of the other crank arm about its spindle axis. The apparatus 100 is also configured to enable these spindle axes to move. In particular, the apparatus 100 is arranged so that the spindle axes themselves may rotate about a central axis from which the spindle axes are separated.

In the examples described herein, the pedal crank arms are coupled to each other via the first and second connection wheels, the first and second belts 117, 127, the first and second central wheels 116, 126, and the central shaft 136. However, it is to be appreciated in the context of the present disclosure that this precise arrangement for coupling the two pedal crank arms so that they rotate together is not to be considered limiting. For example, the connection wheel and the central wheel may be coupled to each other without a belt—e.g. they may have teeth arranged to be interlocked with each other, so that rotation of one wheel causes rotation of the other wheel. For example, the connection wheels may not be provided at all-instead, each pedal crank arm connection/epicyclic arm may be arranged to transmit rotation of the pedal crank arm about the spindle axis into rotation of the central shaft 136 about the central axis. In such examples, a belt or piston-type arrangement may be used to transmit rotation of the pedal crank arm about the spindle axis into rotation of the central shaft 136 about the central axis. Likewise, the central wheels need not be provided—e.g. rotation from the pedal crank arms/connection wheels/belts may be transmitted directly to the central shaft 136.

It is to be appreciated in the context of the present disclosure that each epicyclic arm need not be configured to rotate about the central axis. For example, one or both epicyclic arms may be offset from the central axis, e.g. coupled to the central axis via an additional gear/cog, such that the epicyclic arm(s) rotates about a different point.

It is also to be appreciated that the particular breakout arrangement need not be provided to transmit rotational motion between the first and second epicyclic arms 110, 120. For example, the central shaft 136 may have several layers, e.g. that are separated from each other via one or more bearing interfaces to enable said rotational motion to be transmitted via the central axis. Likewise, it is also to be appreciated that the particular arrangement for transmitting rotational motion between epicyclic arms need not be provided. For example, the driving wheel 142 may be coupled directly to one of the breakout wheels (e.g. with the driving wheel 142 bigger than the breakout wheel so that the driving belt 144 may pass over the breakout wheel). Alternatively, the driving wheel 142 may be provided on the breakout shaft 153 instead of on the central shaft 136. As such, it will be appreciated that the apparatus 100 need not include two transmission wheels, two breakout wheels and a driving wheel 142. It will also be appreciated that the particular arrangement of these wheels shown in the FIGS. need not be considered limiting (e.g. their arrangement left to right, or with transmission and driving wheels on the central shaft 136 and breakout wheels on breakout shaft 153). Other arrangements could be provided to provide the desired functionality. For example, a lazy Susan bearing mechanism may be provided (e.g. which enables rotation of the spindle axis about the central axis in one direction—clockwise or counter-clockwise).

It will also be appreciated that the first and second spindle axes need not be coaxial. In the apparatus 100 described herein, the epicyclic arms are arranged on the apparatus 100 so that they initially extend from the central axis at the same angle, and that they retain that way during use (e.g. if they move). However, this need not be considered limiting, e.g. they could be offset from each other initially, so that two different spindle axes are provided, which may be moved (e.g. rotated about the central axis). It will also be appreciated that the apparatus 100 may be provided without pedal crank arms, as these may be supplied separately. The epicyclic pedal crank arms each comprise a pedal crank arm connection to enable a pedal crank arm to be attached thereto to enable the desired pedalling motion to occur. For example, each pedal crank arm connection may comprise a protrusion which engages with a corresponding recess. A splined connection may be used. For example, each of the first and second pedal crank arm connection 122 may comprise a protrusion which is shaped to engage with a recess in the corresponding crank arm, e.g. so that a rotation of each pedal crank arm drives rotation to be transmitted to the central shaft 136 (e.g. rotation of the connection wheels). Example protrusion shapes may include square taper/octalink type connections, as can be found on conventional bottom brackets for bicycles.

In other examples, pedal crank arms may be provided (e.g. which are coupled to the epicyclic arms, such as via the connection wheels). The pedal crank arms may be arranged to facilitate different sizes for pedal crank. For example, the pedal crank arms may be at least partially telescopic, to enable the distance of the spindle axis from the central axis to be varied. Additionally, or alternatively, the pedal crank arms may comprise multiple locations to which a pedal can be attached. For example, pedals may typically be screwed into a corresponding recess in a pedal crank arm (e.g. a 15 mm diameter threaded hole). Each pedal crank arm may be provided with multiple such recesses for coupling a pedal thereto. For example, the pedal crank arm may be sector-shaped (like a pizza slice) to facilitate a plurality of different pedal screw holes to be provided on the crank arm which are of a similar, but slightly different, radial distance from the central axis.

It is to be appreciated in the context of the present disclosure that any suitable resistance means may be provided. For example, resistance means may enable the pedalling motion of the pedal crank arms about the spindle axis to be subjected to a degree of resistance. This resistance may be selectively variable, e.g. so that the amount of pedalling resistance may change over time (such as through use of a controller). Where a resistance wheel has been described which is coupled to external resistance elements (e.g. flywheel/eddy current brake), this need not be considered limiting. Resistance may be applied using an electromagnetic brake and/or virtual flywheel. This resistance may be applied directly to the resistance wheel, to a component coupled to the resistance wheel such as an external resistance element, or directly to the pedal crank arms/spindles. In examples where a brake of some form is provided, e.g. an eddy current brake etc., a brake lever may be provided which may be controlled by a controller of the apparatus. For example, the lever may be remotely controlled to vary the resistance applied to the pedalling apparatus (e.g. to vary the amount of braking force being applied by the brake).

Any of the wheels described herein may be toothed. For example, the connection wheels, the central wheels, the resistance wheel 132, the driving wheel 142, the transmission wheels and/or the breakout wheels may be toother. Likewise, any of the belts described herein may be toothed. The teeth may be configured to interact with corresponding teeth on other components (e.g. so that teeth of a belt/wheel lock with the belt/wheel to which they are coupled, so that the two rotate together). For example, teeth may be interlockable to enable transmission of rotation between the different wheels/belts. Any of the wheels may be provided by gears (e.g. cogs). It is to be appreciated in the context of the present disclosure that where transmission of rotation between different components is described, this will in practice occur simultaneously. That is, all of the relevant components will commence rotation together at the same. However, to illustrate the functionality and inter-relationship of the different components, this transmission of rotation has been described as though it occurs in a sequence.

It will be appreciated from the discussion above that the examples shown in the figures are merely exemplary, and include features which may be generalised, removed or replaced as described herein and as set out in the claims. As will be appreciated by the skilled reader in the context of the present disclosure, each of the examples described herein may be implemented in a variety of different ways. Any feature of any aspects of the disclosure may be combined with any of the other aspects of the disclosure. For example, method aspects may be combined with apparatus aspects, and features described with reference to the operation of particular elements of apparatus may be provided in methods which do not use those particular types of apparatus. In addition, each of the features of each of the examples is intended to be separable from the features which it is described in combination with, unless it is expressly stated that some other feature is essential to its operation. Each of these separable features may of course be combined with any of the other features of the examples in which it is described, or with any of the other features or combination of features of any of the other examples described herein.

Certain features of the methods described herein may be implemented in hardware, and one or more functions of the apparatus may be implemented in method steps. Accordingly, aspects of the disclosure which are described with reference to products or apparatus are also intended to be implemented as methods and vice versa. The methods described herein may be implemented in computer programs, or in hardware or in any combination thereof. Computer programs include software, middleware, firmware, and any combination thereof. Such programs may be provided as signals or network messages and may be recorded on computer readable media such as tangible computer readable media which may store the computer programs in non-transitory form. Hardware includes computers, handheld devices, programmable processors, general purpose processors, application specific integrated circuits (ASICs), field programmable gate arrays (FPGAs), and arrays of logic gates. For example, any controller described herein may be provided by any control apparatus such as a general purpose processor configured with a computer program product configured to program the processor to operate according to any one of the methods described herein. In addition, the functionality of the controller may be provided by an application specific integrated circuit, ASIC, or by a field programmable gate array, FPGA, or by a configuration of logic gates, or by any other control apparatus. Likewise, any processors used (and any of the activities and apparatus outlined herein) may be implemented with fixed logic such as assemblies of logic gates or programmable logic such as software and/or computer program instructions executed by a processor.

Other examples and variations of the disclosure will be apparent to the skilled addressee in the context of the present disclosure.

The invention claimed is:

1. An epicyclic pedalling apparatus comprising:

a first epicyclic arm comprising a first pedal crank arm connection for coupling a first pedal crank arm to the first epicyclic arm to enable pedalling of said first pedal crank arm about a first spindle axis; and a second epicyclic arm comprising a second pedal crank arm connection for coupling a second pedal crank arm to the second epicyclic arm to enable pedalling of said second pedal crank arm about a second spindle axis;

wherein each of the first and second epicyclic arms is configured to rotate about a central axis and the first spindle axis is offset from the central axis by the first epicyclic arm, so that rotation of the first epicyclic arm about the central axis displaces the first spindle axis, and the second spindle axis is offset from the central axis by the second epicyclic arm, so that rotation of the second epicyclic arm about the central axis displaces the second spindle axis; and wherein the first and second spindle axes are coaxial.

2. The epicyclic pedalling apparatus of claim 1, further comprising a resistance element operable to provide resistance to pedalling of said first and second pedal crank arms.

3. The epicyclic pedalling apparatus of claim 2, wherein the resistance element is configured to provide a selectively variable resistance to pedalling of said first and second pedal crank arms.

4. The epicyclic pedalling apparatus of claim 1, wherein the first and second epicyclic arms are coupled to each other so that pedalling of one of said first and second pedal crank arms about its respective spindle axis also drives a corresponding rotation of the other said pedal crank arm about its respective spindle axis.

5. The epicyclic pedalling apparatus of claim 4, wherein the first epicyclic arm comprises a first connection wheel configured to rotate about the first spindle axis in response to pedalling of said first pedal crank arm; and wherein the second epicyclic arm comprises a second connection wheel configured to rotate about the second spindle axis in response to pedalling of said second pedal crank arm.

6. The epicyclic pedalling apparatus of claim 5, wherein the first connection wheel is coupled to the second connection wheel so that a rotation of one connection wheel drives a corresponding rotation of the other connection wheel.

7. The epicyclic pedalling apparatus of claim 6, wherein the first epicyclic arm comprises a first central wheel configured to rotate about the central axis in response to pedalling of said first pedal crank arm; and wherein the second epicyclic arm comprises a second central wheel configured to rotate about the central axis in response to pedalling of said second pedal crank arm.

8. The epicyclic pedalling apparatus of claim 7, wherein a central shaft couples the first central wheel to the second central wheel so that the first and second central wheel rotate together.

9. The epicyclic pedalling apparatus of claim 8, wherein a resistance element comprises a resistance wheel coupled to the central shaft and configured to resist rotation of the central shaft.

10. The epicyclic pedalling apparatus of claim 9, wherein the resistance wheel is coupled to external resistance means to provide resistance to rotation of the resistance wheel about the central axis thereby to resist rotation of the central shaft.

11. The epicyclic pedalling apparatus of claim 10, wherein the external resistance means comprises a flywheel and/or an eddy current brake.

12. The epicyclic pedalling apparatus of claim 1, further comprising a driving mechanism operable to drive rotation of each said epicyclic arm to provide said movement of the first and second spindle axes.

13. The epicyclic pedalling apparatus of claim 12, wherein the driving mechanism comprises a driving wheel, wherein both of the first and second epicyclic arms are coupled to the driving wheel so that rotation of the driving wheel provides rotation of the first and second epicyclic arms.

14. The epicyclic pedalling apparatus of claim 13, wherein the driving mechanism comprises a driver coupled to the driving wheel and configured to provide selective rotation of said driving wheel thereby to provide selective rotation of the first and second epicyclic arms.

15. The epicyclic pedalling apparatus of claim 14, wherein the driving mechanism comprises two or more breakout wheels arranged to provide a rotational coupling between the first epicyclic arm and the second epicyclic arm.

16. The epicyclic pedalling apparatus of claim 15, wherein the breakout wheels are arranged to rotate about a different axis to the rotational axis of the first and second epicyclic arms; and wherein the pedalling apparatus is arranged to enable transmission of rotation between: (i) the first epicyclic arm and the breakout wheels, and (ii) the second epicyclic arm and the breakout wheels.

17. The epicyclic pedalling apparatus of claim 1, further comprising a controller operable to control at least one of: (i) a pedalling resistance for the epicyclic pedalling apparatus, and (ii) a rotational position of the first and second spindle axes.

18. An exercise apparatus comprising:

the epicyclic pedalling apparatus of claim 1; and a gantry;

wherein the gantry is operable to vary an elevation of the epicyclic pedalling apparatus relative to a user of the pedalling apparatus.

19. A method of controlling operation of an epicyclic pedalling apparatus, the epicyclic pedalling apparatus comprising:

(i) a first pedal crank arm coupled to a first epicyclic arm and arranged to be pedalled about a first spindle axis, and (ii) a second pedal crank arm coupled to a second epicyclic arm and arranged to be pedalled about a second spindle axis, wherein each of the first and second epicyclic arms is configured to rotate about a central axis and the first spindle axis is offset from the central axis by the first epicyclic arm, so that rotation of the first epicyclic arm about the central axis displaces the first spindle axis, and the second spindle axis is offset from the central axis by the second epicyclic arm, so that rotation of the second epicyclic arm about the central axis displaces the second spindle axis; and wherein the apparatus is arranged to enable:

(i) the first epicyclic arm to rotate to move the first spindle axis, and (ii) the second epicyclic arm to rotate to move the second spindle axis; and wherein the first and second spindle axes are coaxial and wherein each of the first and second epicyclic arms is configured to rotate about a central axis to provide said respective movement of the coaxial first and second spindle axes, wherein the method comprises controlling at least one of:

(a) rotational movement of the first epicyclic arm to control the position of the first spindle axis, (b) rotational movement of the second epicyclic arm to control the position of the second spindle axis, (c) a pedalling resistance for pedalling of the first and second pedal crank arms about their respective spindle axes, wherein the first and second spindle axes are coaxial, and wherein the first and second epicyclic arms rotate about a central axis to provide said respective movement of the coaxial first and second spindle axes.

20. A computer program product comprising computer program instructions configured to program a controller to perform the method of claim 19.

* * * * *